US007890008B2

(12) United States Patent
Yamaji

(10) Patent No.: US 7,890,008 B2
(45) Date of Patent: Feb. 15, 2011

(54) IMAGE FORMING APPARATUS AND RECORDING MEDIUM ON WHICH INTERRUPT CONTROL PROGRAM IS RECORDED

(75) Inventor: Hiroyuki Yamaji, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 28 days.

(21) Appl. No.: 12/542,758

(22) Filed: Aug. 18, 2009

(65) Prior Publication Data

US 2010/0054767 A1 Mar. 4, 2010

(30) Foreign Application Priority Data

Aug. 26, 2008 (JP) ..... 2008-217227

(51) Int. Cl.
*G03G 15/20* (2006.01)

(52) U.S. Cl. ..... 399/69; 399/70

(58) Field of Classification Search ..... 399/38, 399/67, 69, 70, 122, 320, 328
See application file for complete search history.

(56) References Cited

U.S. PATENT DOCUMENTS 5,659,386 A * 8/1997 Yamada ..... 399/194
7,127,188 B2 10/2006 Akita et al.
7,151,903 B2 * 12/2006 Wu et al. ..... 399/69
2004/0218198 A1 * 11/2004 Ozaki ..... 358/1.8

FOREIGN PATENT DOCUMENTS

| | | |
|---|---|---|
| JP | 61-022358 | 1/1986 |
| JP | 62-047679 | 3/1987 |
| JP | 2005-202359 | 7/2005 |
| JP | 2006-220697 | 8/2006 |
| JP | 2007-206287 | 8/2007 |

* cited by examiner

*Primary Examiner*—Hoan Tran
(74) *Attorney, Agent, or Firm*—Renner, Otto, Boiselle & Sklar, LLP

(57) ABSTRACT

An image forming apparatus is provided having a fixing device which heats a fixing roller from the surface thereof by means of an external heating device, which image forming apparatus is capable of improving fixability immediately just after a start-up and enhancing a job efficiency. An image forming apparatus includes a toner image forming section, a transfer section, a fixing device, and an interrupt control section. At least two levels are set as a job interrupt reference temperature, the interrupt control section individually selects, from among the at least two levels of job interrupt reference temperature, the level to be used for either or both of a job immediately after the start-up from a power-on and a job immediately after a return from a sleep mode, and the level(s) for other job(s), and carries out an interrupt control using the selected level of job interrupt reference temperature.

5 Claims, 9 Drawing Sheets

IMAGE FORMING APPARATUS AND RECORDING MEDIUM ON WHICH INTERRUPT CONTROL PROGRAM IS RECORDED

CROSS-REFERENCE TO RELATED APPLICATION

This application claims priority to Japanese Patent Application No. 2008-217227, which was filed on Aug. 26, 2008, the contents of which are incorporated herein by reference in their entirety.

BACKGROUND OF THE INVENTION

1. Field of the Invention

The present invention relates to an image forming apparatus and a recording medium on which an interrupt control program is recorded.

2. Description of the Related Art

An electrophotographic image forming apparatus is capable of forming a high-quality image with favorable reproducibility and operability at low cost. This is why the electrophotographic image forming apparatus has been widely used in a copier, a printer, a facsimile machine, a multifunction machine having two or more of these functions just stated, and the like machine. The electrophotographic image forming apparatus includes, for example, a photoreceptor, a charging device, an exposing device, a developing device, a transfer device, and a fixing device. The photoreceptor is a member on whose surface an electrostatic latent image corresponding to image information is formed. The charging device serves to charge a surface of the photoreceptor. The exposing device serves to irradiate the charged surface of the photoreceptor with signal light to thereby form an electrostatic latent image. The developing device serves to supply a toner to the electrostatic latent image formed on the surface of the photoreceptor, to thereby form a toner image. The transfer device serves to transfer the toner image formed on the surface of the photoreceptor to a recording sheet. The fixing device serves to fix the toner image on the recording sheet to thereby form an image.

For the fixing device, for example, a fixing device including a fixing roller and a pressure roller is used. The fixing roller contains a heating portion therein which generates heat and fuses the toner constituting the toner image not yet fixed on the recording sheet to fix the toner image on the recording sheet in cooperation with the pressure roller. The pressure roller is disposed in pressure-contact with the fixing roller, and presses the recording sheet against the fixing roller when the toner is heated to be fused by the fixing roller, thereby promoting the fixing of the toner onto the recording sheet. A pressure-contact region between the fixing roller and the pressure roller is named a fixing nip region. The recording sheet bearing the not-yet-fixed toner image is introduced to the fixing nip region with a toner image bearing surface of the recording sheet in contact with the surface of the fixing roller.

Meanwhile, with a color image, an amount of toner used per unit area on the recording sheet is around two to three times larger than with a common monochrome image. Therein, in order to sufficiently fuse toner and obtain a good color fixed image, a color fixing device is adapted in such a way that the width of a fixing nip is increased by increasing the outer diameter of the fixing roller, increasing the thickness of a rubber layer formed on the fixing roller surface, or the like.

However, this kind of adaptation causes increasing the heat capacity of the fixing roller and, in the event that this kind of fixing roller with a high heat capacity is heated only by a heating source included therein, problems occur, such as a start-up time delay, or a decrease in fixing performance due to a decrease in temperature followability of the fixing roller at a continuous output time. Therein, in order to solve these problems, a configuration is proposed wherein a heating source is disposed outside the fixing roller, and the rate of temperature increase of the fixing roller is accelerated by heating the fixing roller from the surface thereof. With the fixing device with this kind of configuration, at a start-up operation time, by rotating the fixing roller, and heating the fixing roller from the exterior thereof using an external heating belt, the surface temperature of the fixing roller is caused to rise rapidly, achieving a reduction of start-up time.

With the configuration of heating the fixing roller from the exterior using an external heating device, unlike a configuration of heating the fixing roller from the interior using an internal heat source, the configuration is such that it is possible only to locally heat the surface of the fixing roller. Generally, it is necessary to heat while rotating the fixing roller in order to uniformly heat the fixing roller surface while transmitting heat by means of an external heating roller kept at a high temperature of around 200° C., a belt heat source, and a nip region formed by the fixing roller and external heat source. Specifically, when the image forming apparatus is powered on and started up, and when it is returned from a sleep mode, it is necessary, when uniformly heating the fixing roller surface using the external heating device, to rotate the fixing roller from a condition of a low temperature such as room temperature. The sleep mode is a mode in which a central processing unit (CPU) or the like is energized, but a heater of the fixing device is not energized, suppressing power consumption. During a standby period, by stopping the fixing roller, and uniformly heating the fixing roller from the interior thereof using a halogen lamp or the like provided inside the fixing roller, the temperature of the fixing roller is maintained at a certain temperature.

The temperature of the fixing roller immediately after the start-up is the highest on the surface thereof, and tends to decrease toward the interior (a metal core side) of the fixing roller, and contrarily, the temperature of the fixing roller in a standby condition is the highest inside the fixing roller, and tends to decrease toward the surface of the fixing roller. As the temperature distribution from the interior to surface of the fixing roller immediately after the start-up, and that in the standby condition, tend to be totally opposite to each other in this way, in the event of carrying out a continuous output immediately after the start-up, the fixing roller surface is rapidly deprived of heat by paper, making only a supply of heat from the external heating device insufficient to maintain the fixing temperature, and there is a fear that the fixability decreases.

Japanese Unexamined Patent Publication JP-A 2005-202359 discloses an image forming apparatus which, in order to ensure fixability, temporarily stops a job when the temperature of a fixing roller decreases to a reference temperature (hereinafter described also as a "job interrupt reference temperature"), and starts the job again when the temperature of the fixing roller recovers the reference temperature, thus ensuring the fixability.

However, with the image forming apparatus disclosed in JP-A 2005-202359, as the job interrupt reference temperature is uniformly determined without distinguishing between being immediately after the start-up and in the standby condition, there being a problem with a decrease in job efficiency and the fixability immediately after the start-up, a poor fixing or the decrease in job efficiency occurs when printing the job immediately after the start-up.

SUMMARY OF THE INVENTION

An object of the invention is to provide an image forming apparatus having a fixing device which heats a fixing roller from a surface thereof by means of an external heating device, which image forming apparatus is capable of improving the fixability just after a start-up of the image forming apparatus and suppressing reduction of job efficiency, and a recording medium on which an interrupt control program is recorded.

The invention provides an image forming apparatus including:

a toner image forming section which includes an image bearing member and forms a toner image on a surface of the image bearing member;

a transfer section which transfers the toner image on the surface of the image bearing member to a recording sheet;

a fixing device which fixes the unfixed toner on the recording sheet, the fixing device including:

a fixing member which heats the recording sheet bearing an unfixed toner image, and fuses toner constituting the unfixed toner image, a pressure member which is provided so as to be pressed against the fixing member to form a pressure-contact region between the pressure member and the fixing member, and pressurizes the recording sheet bearing the unfixed toner image which is conveyed to the pressure-contact region so as to fix the unfixed toner image on the recording sheet in cooperation with the fixing member, an external heating section which is provided so as to come into contact with a peripheral surface of the fixing member from an exterior thereof, and heats the peripheral surface, and a fixing member temperature detection section which detects a surface temperature of the fixing member; and an interrupt control section which carries out an interrupt control so as to interrupt a job printing when the surface temperature of the fixing member during the job printing which is detected by the fixing member temperature detection section decreases to a job interrupt reference temperature, wherein at least two levels are set as the job interrupt reference temperature, and the job interrupt control section individually selects, from among the at least two levels set as the job interrupt reference temperature, the level to be used for either or both of a job immediately after a start-up from a power-on and a job immediately after a return from a sleep mode, and the level(s) for other job(s), and carries out the interrupt control using the selected level of job interrupt reference temperature.

According to the invention, the image forming apparatus includes the toner image forming section, transfer section, the fixing device, and interrupt control section. The external heating section included in the fixing device, is provided so as to come into contact with the peripheral surface of the fixing member from the exterior thereof, and heats the peripheral surface. When the recording sheet on which the toner image is formed is supplied to a region in which the fixing member and pressure member are pressed against each other, the toner on a surface of the recording sheet bearing the unfixed toner image is heated by the fixing member, and the unfixed toner image is fixed to the recording sheet by the pressure of the fixing member and pressure member. The fixing member temperature detection section detects the surface temperature of the fixing member. The interrupt control section carries out the interrupt control so as to interrupt the job printing when the surface temperature of the fixing member during the job printing which is detected by the fixing member temperature detection section decreases to the job interrupt reference temperature.

In a case in which a job printing is started immediately after the apparatus is started up from a condition in which the surface temperature of the fixing member is as low as room temperature, or immediately after the apparatus is returned from the condition in which the surface temperature of the fixing member is as low as room temperature, the rate of decrease in the surface temperature of the fixing member immediately after the starting of the job printing is higher than in a case in which the job printing is started from a condition in which the surface temperature of the fixing member is high. For this reason, in the event that there is only one level of job interrupt reference temperature, and the job interrupt reference temperature is set to a lowest fixing temperature, on the job printing being started immediately after the start-up from the condition in which the surface temperature of the fixing member is low or immediately after the return from the condition in which the surface temperature of the fixing member is low, the surface temperature of the fixing member decreases rapidly, and therefore there is a fear that, even in the event that the interrupt control is carried out at the point at which the surface temperature of the fixing member decreases to the job interrupt reference temperature, the surface temperature of the fixing member falls below the job interrupt reference temperature, and a poor fixing occurs.

In order to solve such a problem, in the event that the job interrupt reference temperature is set to such a high temperature that the surface temperature of the fixing member does not fall below the lowest fixing temperature even in the event that the job printing is started immediately after the start-up from the condition in which the surface temperature of the fixing member is low, or immediately after the return from the condition in which the surface temperature of the fixing member is low, in the case of starting printing a job other than a job immediately after the start-up or immediately after the return, the job printing is interrupted when the surface temperature of the fixing member decreases below the job interrupt reference temperature, even though it does not fall below the lowest fixing temperature, and therefore the job efficiency decreases.

Since at least two levels are set as the job interrupt reference temperature, it is possible to select and use a level of job interrupt reference temperature which matches the situation. It is possible to realize an image forming apparatus with which the interrupt control section individually selects, from among the at least two levels set as the job interrupt reference temperature, the level to be used for either or both of a job immediately after the start-up from the power-on and a job immediately after the return from the sleep mode (hereinafter described as "immediately after the start-up or immediately after the return"), and the level(s) for other job(s), and carries out the interrupt control using the selected level of job interrupt reference temperature, whereby it is possible to achieve a balance between an ensuring of fixability and the job efficiency.

In the invention, it is preferable that the job interrupt reference temperature includes a first reference temperature and a second reference temperature lower than the first reference temperature, and the interrupt control section selects the first reference temperature for either or both of a job immediately after the start-up from the power-on and a job immediately after the return from the sleep mode, selects the second reference temperature for other job(s) and use these selected temperatures to carry out the interrupt control.

According to the invention, the job interrupt reference temperature includes the first reference temperature and the second reference temperature lower than the first reference temperature. As the interrupt control section selects the first reference temperature for either or both of a job immediately after the start-up from the power-on and a job immediately after the return from the sleep mode, selects the second reference temperature for other job(s) and use these selected temperatures to carry out the interrupt control, it is possible to set the job interrupt reference temperature to the first reference temperature, which is comparatively high, in the event that the rate of decrease in the surface temperature of the fixing member immediately after a printing is started is comparatively high, and it is possible to set the job interrupt reference temperature to the second reference temperature, which is comparatively low, in the event that the rate of decrease in the surface temperature of the fixing member immediately after the printing is started is comparatively low. Consequently, since it is possible to prevent the poor fixing when printing a job immediately after the start-up or immediately after the return, it is possible to suppress a decrease in the job efficiency when printing other job(s). Consequently, it is possible to ensure the fixability, and at the same time, suppress the decrease in the job efficiency.

Also, in the invention, it is preferable that in either or both of a case where a job printing is started from the power-on, and a case where a job printing is started by the return from the sleep mode, at the start of the start-up from the power-on, or at the start of the return from the sleep mode, in the event that the surface temperature of the fixing member detected by the fixing section temperature detection section is higher than or equal to a predetermined temperature, and the job interrupt reference temperature is the first reference temperature, the interrupt control section changes the job interrupt reference temperature from the first reference temperature to the second reference temperature, and carries out the interrupt control, while in the event that the surface temperature of the fixing member detected by the fixing section temperature detection section is lower than the predetermined temperature, the interrupt control section maintains the job interrupt reference temperature at the first reference temperature, and carries out the interrupt control.

According to the invention, in either or both of a case where a job printing is started from the power-on, and a case where a job printing is started by the return from the sleep mode, at the start of the start-up from the power-on, or at the start of the return from the sleep mode, in the event that the surface temperature of the fixing member detected by the fixing section temperature detection section is higher than or equal to the predetermined temperature, and the job interrupt reference temperature is the first reference temperature, the interrupt control section changes the job interrupt reference temperature from the first reference temperature to the second reference temperature, and carries out the interrupt control, while in the event that the surface temperature of the fixing member detected by the fixing section temperature detection section is lower than the predetermined temperature, the interrupt control section maintains the job interrupt reference temperature at the first reference temperature, and carries out the interrupt control. For example, in the event that the apparatus is powered off and immediately on, and started up immediately after that, the surface temperature of the fixing member hardly decreases, and still remains high. In this way, in the event that the surface temperature of the fixing member is high at the start of the start-up, even in the event that the interrupt control is carried out with the job interrupt reference temperature changed from the first reference temperature to the second reference temperature, as the rate of decrease in the surface temperature of the fixing member is low when printing the job immediately after the start-up, no poor fixing occurs. Also, as the job printing is continued without interruption even in the event that the surface temperature of the fixing member decreases to the first reference temperature, it is possible to enhance the job efficiency further than in the case in which the interrupt control is carried out with the job interrupt reference temperature maintained at the first reference temperature. Consequently, it is possible to ensure the fixability, and at the same time, further suppress the decrease in the job efficiency.

Also, in the invention, it is preferable that in either or both of a case where a job printing is started from the power-on, and a case where a job printing is started by the return from the sleep mode, when the job interrupt reference temperature is the first reference temperature, when a predetermined time has elapsed from the time of completion of the start-up from the power-on or the time of completion of the return from the sleep mode, the interrupt control section changes the job interrupt reference temperature to the second reference temperature, and carries out the interrupt control.

According to the invention, in either or both of a case where a job printing is started from the power-on, and a case where a job printing is started by the return from the sleep mode, when the job interrupt reference temperature is the first reference temperature, when a predetermined time has elapsed from the time of completion of the start-up from the power-on or the time of completion of the return from the sleep mode, the interrupt control section changes the job interrupt reference temperature to the second reference temperature, and carries out the interrupt control. When the predetermined time has elapsed from the time of completion of the start-up from the power-on or the time of completion of the return from the sleep mode, the fixing member is sufficiently heated as far as the interior, and the rate of decrease in the surface temperature of the fixing member along with the job printing becomes lower, and therefore no poor fixing occurs even in the event that the job interrupt reference temperature is changed to the comparatively low second reference temperature. Also, due to the fact that the job interrupt reference temperature has been changed, the job printing is continued without interruption even in the event that the surface temperature of the fixing member decreases to the comparatively high first reference temperature, and therefore it is possible to enhance the job efficiency further than in the case in which the interrupt control is carried out with the job interrupt reference temperature changed to the first reference temperature. Consequently, it is possible to ensure the fixability, and at the same time, further suppress the decrease in the job efficiency.

Also, the invention may provide a computer readable recording medium on which an interrupt control program for carrying out the interrupt control is recorded, the interrupt control program causing a computer to function as the interrupt control section.

According to the invention, by making a computer execute the interrupt control program recorded on the recording medium, the computer is caused to function as an interrupt control section provided in the image forming apparatus. Accordingly, it is possible to control a determination of the job interrupt reference temperature by means of software.

Also, an operation of the fixing member can be implemented by a computer, using the interrupt control program retrieved from the recording medium.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
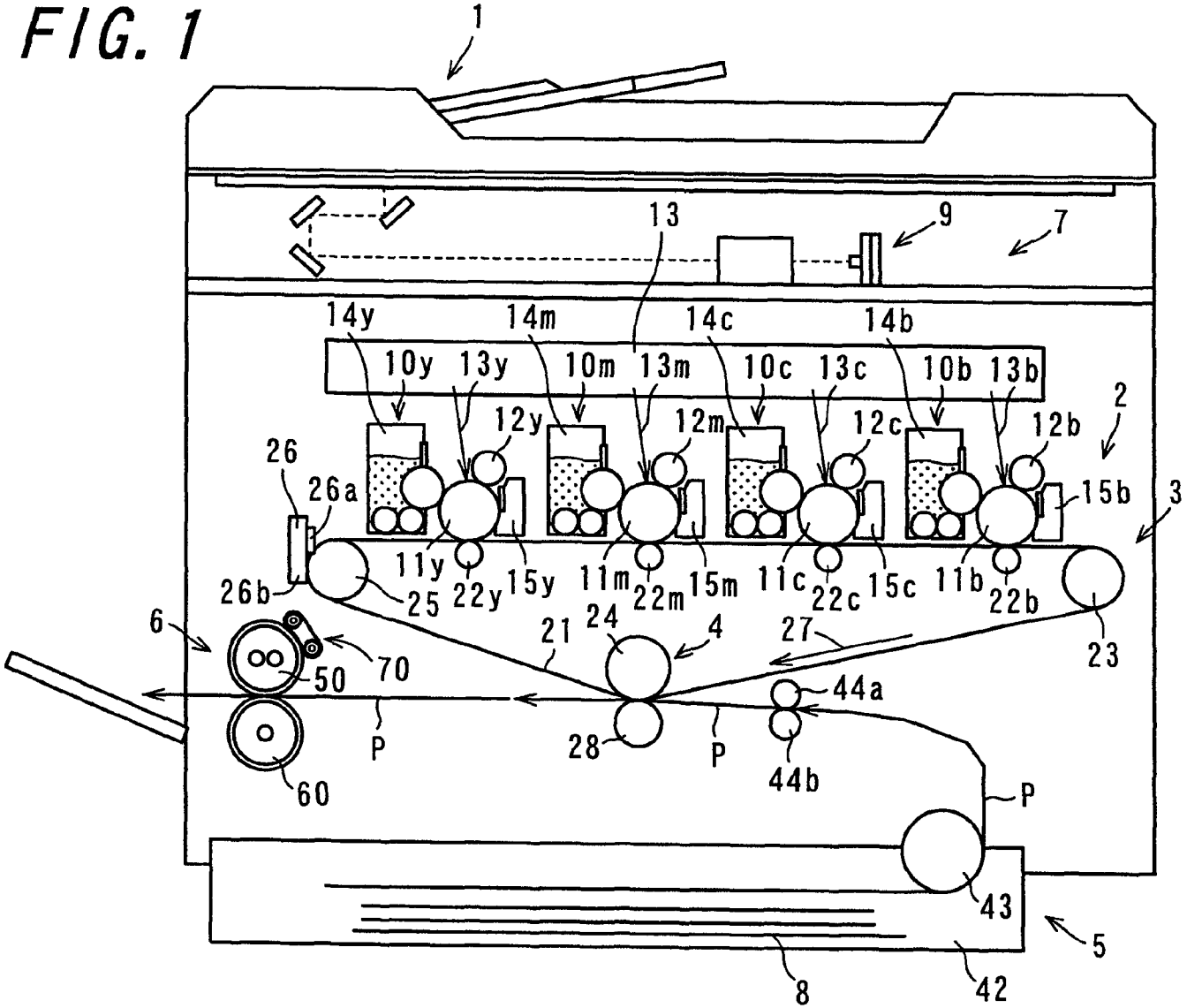
FIG. 1 is a sectional view schematically showing a configuration of an image forming apparatus according to a first embodiment of the invention.

Now referring to the drawings, preferred embodiments of the invention are described below.

1. Image Forming Apparatus

An image forming apparatus according to a first embodiment of the invention includes a toner image forming section, a transfer section, a fixing device, and an interrupt control section. The toner image forming section includes an image bearing member and forms a toner image on a surface of the image bearing member. The transfer section transfers the toner image on the surface of the image bearing member to a recording sheet. The fixing device fixes an unfixed toner image on the recording sheet. The fixing device includes a fixing member which heats the recording sheet bearing an unfixed toner image, and fuses toner constituting the unfixed toner image, a pressure member which is provided so as to be pressed against the fixing member to form a pressure-contact region between the pressure member and the fixing member, and pressurizes the recording sheet bearing the unfixed toner image which is conveyed to the pressure-contact region so as to fix unfixed image on the recording sheet in cooperation with the fixing member, an external heating section which is provided so as to come into contact with a peripheral surface of the fixing member from an exterior thereof, and heats the peripheral surface, and a fixing member temperature detection section which detects a surface temperature of the fixing member. The interrupt control section carries out an interrupt control so as to interrupt a job printing when the surface temperature of the fixing member during the job printing which is detected by the fixing member temperature detection section decreases to a job interrupt reference temperature.

At least two levels are set as the job interrupt reference temperature, and the interrupt control section individually selects, from among the at least two levels set as the job interrupt reference temperature, the level to be used for either or both of a job immediately after a start-up from a power-on and a job immediately after a return from a sleep mode, and the level(s) for other job(s), and carries out the interrupt control using the selected level of job interrupt reference temperature.

FIG. 1 is a sectional view schematically showing a configuration of an image forming apparatus 1 according to the embodiment. The image forming apparatus 1 is an electrophotographic image forming apparatus in tandem configuration which forms an image in a manner that toner images of four colors of yellow, magenta, cyan, and black are sequentially transferred and overlaid on top of one another to thereby form a multicolor toner image, and the multicolor toner image is fixed on a recording sheet. The image forming apparatus 1 includes a toner image forming section 2, an intermediate transfer section 3, a secondary transfer section 4, a recording sheet supplying section 5, a fixing device 6, and a scanner section 7.

(1) Toner Image Forming Section

The toner image forming section 2 includes image forming units 10*y*, 10*m*, 10*c*, and 10*b*. The image forming units 10*y*, 10*m*, 10*c*, and 10*b* are aligned in a row from an upstream side along a rotational direction (sub-scanning direction) of a later-described intermediate transfer belt 21, i.e., a direction of an arrow 27. The image forming units 10*y*, 10*m*, 10*c*, and 10*b* form toner images of the respective colors as follows. In the image forming units 10*y*, 10*m*, 10*c*, and 10*b*, electrostatic latent images are formed which correspond to image information of the respective colors inputted as digital signals, and toners of corresponding colors are then supplied to the electrostatic latent images to thereby develop the images. The image forming unit 10*y* forms a toner image corresponding to yellow image information. The image forming unit 10*m* forms a toner image corresponding to magenta image information. The image forming unit 10*c* forms a toner image corresponding to cyan image information. The image forming unit 10*b* forms a toner image corresponding to black image information.

Figure 2:
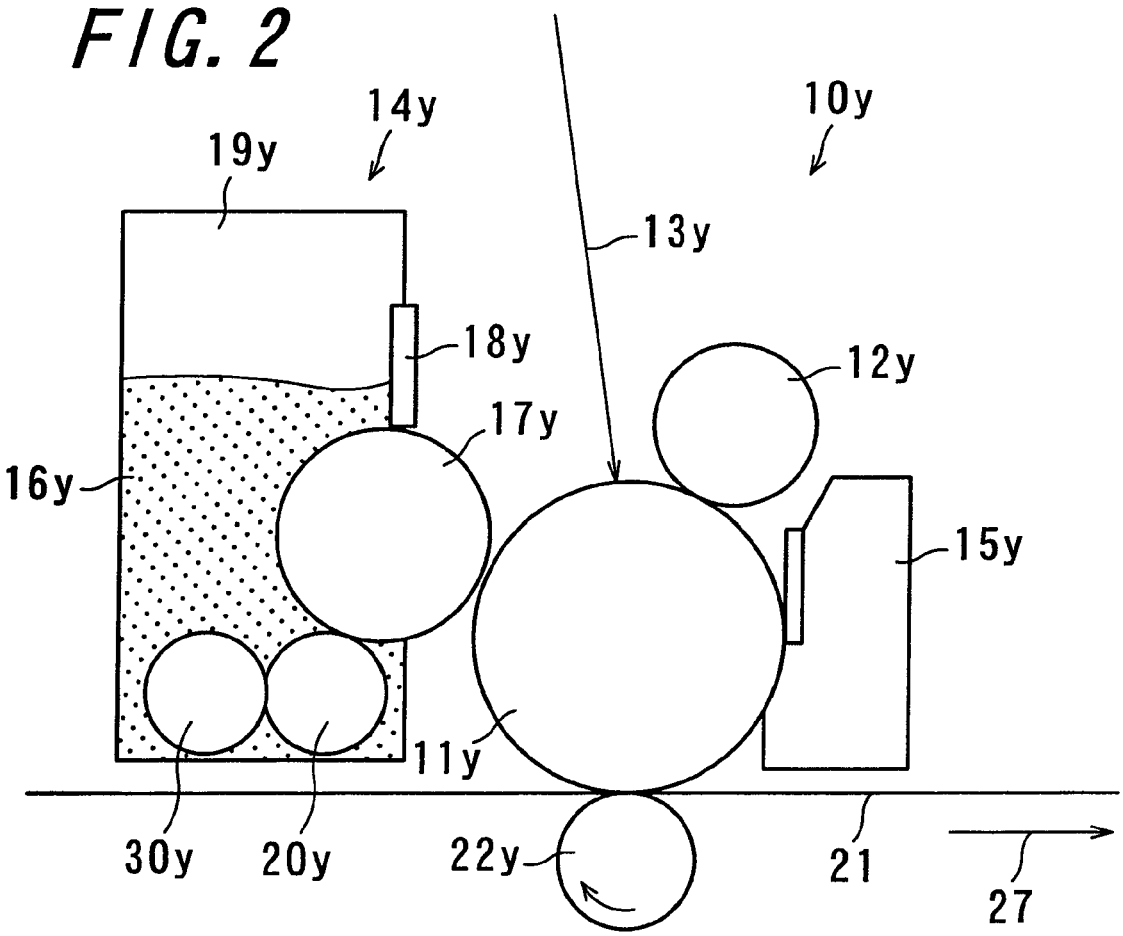
FIG. 2 is an enlarged sectional view showing a configuration of an image forming unit of a toner image forming section shown in FIG. 1.

FIG. 2 is an enlarged sectional view showing a configuration of the image forming unit 10*y* of the toner image forming section 2 shown in FIG. 1. As shown in FIG. 2, the image forming unit 10*y* includes a photoreceptor drum 11*y*, a charging roller 12*y*, a light scanning unit 13, a developing device 14*y*, and a drum cleaner 15*y*.

The photoreceptor drum 11*y* is a roller-shaped member that is supported so as to be rotatable about an axis thereof by a driving portion (not shown) and that has a photosensitive layer on which surface the electrostatic latent image and thus the toner image are formed. The usable photoreceptor drum 11*y* may be composed of a conductive substrate (not shown) and a photosensitive layer (not shown) formed on a surface of the conductive substrate. An applicable shape of the conductive substrate may be cylindrical, columnar, sheet-like, etc., among which cylindrical is preferable. Examples of the photosensitive layer include an organic photosensitive layer and an inorganic photosensitive layer. The organic photosensitive layer may be a laminate composed of a charge generating layer which is a resin layer containing a charge generating substance, and a charge transporting layer which is a resin layer containing a charge transporting substance, or may be a resin layer which contains a charge generating substance and a charge transporting substance in a single resin layer. The inorganic photosensitive layer may be a layer which contains one or two or more of zinc oxide, selenium, amorphous silicon, and the like substance.

Between the conductive substrate and the photosensitive layer may be interposed an undercoat layer, and a surface of the photosensitive layer may be provided with a surface layer (a protective layer) for protecting the photosensitive layer mainly. In the present embodiment, a 30 mm-diameter photoreceptor drum is used which contains an aluminum tube (a conductive substrate) connected to ground potential (GND) and a 20 μm-thick organic photosensitive layer formed on a surface of the aluminum tube. Further, in the embodiment, the photoreceptor drum 11*y* rotates in a clockwise direction at a peripheral velocity of 355 mm/s.

The charging roller 12*y* is a roller-shaped member which is supported so as to be rotatable about an axis thereof by a driving portion (not shown) and which charges the surface of the photoreceptor drum 11*y* with predetermined polarity and potential. The charging roller 12*y* is connected to a power source (not shown). Application of voltage by the power source to the charging roller 12*y* causes discharge of electricity to thereby charge the surface of the photoreceptor drum 11*y*. In the embodiment, voltage of −1200 V is applied to the charging roller 12*y*, and the surface of the photoreceptor drum 11*y* is thereby charged to −600 V. The charging roller 12*y* can be replaced by a brush-type charging device, a charger-type charging device, and a corona charging device such as a scorotron charger. The light scanning unit 13 irradiates the charged surface of the photoreceptor drum 11*y* with laser light 13*y* corresponding to yellow image information to thereby form on the surface of the photoreceptor drum 11*y* an electrostatic latent image corresponding to the yellow image information. For the light scanning unit 13, a semiconductor laser or the like component can be used. In the embodiment, an electrostatic latent image having an exposure potential of −70 V is formed on the surface of the photoreceptor drum 11*y* which surface has been charged to −600 V.

The developing device 14*y* includes a developing roller 17*y*, a developing blade 18*y*, a developer tank 19*y*, and stirring rollers 20*y* and 30*y*. The developing roller 17*y* bears a yellow developer 16*y* on a surface thereof and supplies the yellow developer 16*y* to the electrostatic latent image on the surface of the photoreceptor drum 11*y* at a region where the developing roller 17*y* and the photoreceptor drum 11*y* come close to each other (named as "a developing nip region"). The developing roller 17*y* is a roller-shaped member that is supported so as to be rotatable about an axis thereof by the developer tank 19*y* and is disposed so as to have a part thereof protrude outward from an opening formed on a surface of the developer tank 19*y* which surface faces the photoreceptor drum 11*y*, to thereby come close to the surface of the photoreceptor drum 11*y*, and that internally contains fixed magnetic poles (not shown). The developing roller 17*y* rotates in a direction opposite to a rotational direction of the photoreceptor drum 11*y*. Accordingly, at the developing nip region, the developing roller 17*y* and the photoreceptor drum 11*y* rotate in the same direction. Further, the developing roller 17*y* is connected to a power source (not shown), and DC voltage (development voltage) is applied to the developing roller 17*y*. This causes the yellow developer 16*y* on the surface of the developing roller 17*y* to be smoothly supplied to the electrostatic latent image.

In the embodiment, development voltage of −420 V is applied to the developing roller 17*y*. An yellow toner layer on the surface of the developing roller 17*y* contacts with the photoreceptor drum 11*y* at the developing nip region where the yellow developer 16*y* is thereby supplied to the electrostatic latent image.

The developing blade 18*y* is a plate-like member which is provided so as to have one end supported by the developer tank 19*y* and the other end distanced away from the surface of the developing roller 17*y*. The developing blade 18*y* is used for homogenization (layer regulation) of the yellow toner layer borne on the surface of the developing roller 17*y*.

The developer tank 19*y* is a container-shaped member which has the opening on the surface facing the photoreceptor drum 11*y* as described above and which has an internal space. The developer tank 19*y* contains the developing roller 17*y* and the stirring rollers 20*y* and 30*y* housed in the internal space, and stores the yellow developer 16*y* therein. The developer tank 19*y* is replenished with the yellow developer 16*y* which is supplied from a toner cartridge (not shown) according to a consumption situation of the yellow developer 16*y*. In the embodiment, the developer tank 19 has been filled with magnetic carrier in advance. The magnetic carrier is mixed with a yellow toner supplied to the developer tank 19*y*, resulting in the yellow developer (a yellow two-component developer) 16*y*. A form of the developer is however not limited to the above form of two-component developer, and a form of one-component developer containing yellow toner only is also applicable.

The stirring rollers 20*y* and 30*y* are screw-shaped members which are supported so as to be rotatable about respective axis thereof in the internal space of the developer tank 19*y*. The stirring roller 20*y* is disposed so as to come into pressure-contact with the surface of the developing roller 17*y*. The stirring rollers 20*y* and 30*y* respectively rotate to thereby supply the yellow developer 16*y* which is supplied from the toner cartridge (not shown) into the developer tank 19*y*, to a vicinity of the surface of the developing roller 17*y*. In the developing device 14*y*, the yellow developer 16*y* which has been formed by attaching the yellow toner to the magnetic carrier in the developer tank 19*y*, is supplied by the stirring rollers 20*y* and 30*y* to the surface of the developing roller 17*y* on which a developer layer is thereby formed. A thickness of the developer layer is homogenized by the developing blade 18*y* and then, from the developer layer, the yellow developer 16*y* is selectively supplied to the electrostatic latent image on the surface of the photoreceptor drum 11*y* by using a difference in potential, resulting in a yellow toner image corresponding to the yellow image information.

The drum cleaner 15*y* removes and thus collects the yellow developer 16*y* which remains on the surface of the photoreceptor drum 11*y* after the yellow toner image has been transferred from the surface of the photoreceptor drum 11*y* to the intermediate transfer belt 21 as will hereinafter be described.

In the image forming unit 10*y*, the light scanning unit 13 irradiates the surface of photoreceptor drum 11*y* which has been charged by the charging roller 12*y*, with the signal light 13*y* corresponding to the yellow image information, thereby forming the electrostatic latent image which is then developed with the yellow developer 16*y* supplied thereto from the developing device 14*y*, with the result that the yellow toner image is formed. The yellow toner image is transferred to the intermediate transfer belt 21 which comes into pressure-contact with the surface of the photoreceptor drum 11*y* and rotates in a direction of an arrow 29 as will hereinafter be described. The yellow developer 16*y* remaining on the surface of the photoreceptor drum 11*y* is removed and thus collected by the drum cleaner 15*y*. This image (toner image) forming operation is repeatedly carried out.

The image forming units 10*m*, 10*c*, and 10*b* respectively have the configurations corresponding to the image forming unit 10*y* except that a magenta toner, a cyan toner, or a black toner is used respectively instead of the yellow toner. Descriptions of the image forming units 10*m*, 10*c*, and 10*b* will be thus omitted by giving the same reference symbols as those in the image forming unit 10*y*, which symbols will be followed respectively by "m" indicative of magenta, "c" indicative of cyan, and "b" indicative of black.

(2) Transfer Section

Returning to FIG. 1, the intermediate transfer section 3 includes an intermediate transfer belt 21, primary transfer rollers 22*y*, 22*m*, 22*c*, and 22*b*, support rollers 23, 24, and 25, and a belt cleaner 26. The intermediate transfer belt 21 is an endless belt shaped toner image bearing member which is supported around the support rollers 23, 24, and 25 with tension and forms a looped moving pathway, and rotates in the direction of an arrow 27 at approximately the same circumferential speed as that of the photoreceptor drums 11*y*, 11*m*, 11*c*, and 11*b*. As the intermediate transfer belt 21, it is possible to use, for example, a 100-μm-thick polyimide film. A material of the intermediate transfer belt 21 not being limited to polyimide, it is possible to use a film made of a synthetic resin, such as polycarbonate, polyamide, polyester, or polypropylene, various kinds of rubber, or the like. The film made of a synthetic resin or each kind of rubber contains an electrically conductive material, such as furnace black, thermal black, channel black, or graphite carbon, in order to adjust an electric resistance value with which it acts as the intermediate transfer belt 21. A toner image bearing surface 21*a* of the intermediate transfer belt 21 is pressed against the photoreceptor drums 11*y*, 11*m*, 11*c*, and 11*b*, in the order named, from an upstream side in a rotational drive direction of the intermediate transfer belt 21. Positions in which the intermediate transfer belt 21 is pressed against the photoreceptor drums 11*y*, 11*m*, 11*c*, and 11*b* are intermediate transfer positions of individual color toner images. The primary transfer rollers 22*y*, 22*m*, 22*c*, and 22*b* are disposed in positions facing the photoreceptor drums 11*y*, 11*m*, 11*c*, and 11*b* across the intermediate transfer belt 21.

The primary transfer rollers 22*y*, 22*m*, 22*c*, and 22*b* are roller-shaped members which face the photoreceptor drums 11*y*, 11*m*, 11*c*, and 11*b* respectively across the intermediate transfer belt 21, and are pressed against a surface of the intermediate transfer belt 21 opposite to the toner image bearing surface 21*a*, and provided so as to be able to be rotationally driven around their own axes by drive portions (not shown). As the primary transfer rollers 22*y*, 22*m*, 22*c*, and 22*b*, it is possible to use, for example, a roller shaped member including a metallic shaft and an electrically conductive layer covering the surface of the metallic shaft. The shaft is formed of metal, for example, stainless steel. The diameter of the shaft, although not particularly limited, is preferably 8 to 10 mm. The electrically conductive layer is formed of an electrically conductive elastic body or the like. As the electrically conductive elastic body, one commonly used in this field is available, and examples thereof include ethylene propylene diene rubber (EPDM), EPDM foam, and urethane foam, which contain an electrically conductive agent such as carbon black. A high voltage is uniformly applied to the intermediate transfer belt 21 by virtue of the electrically conductive layer.

In order to transfer the toner images formed on the surfaces of the photoreceptor drums 11*y*, 11*m*, 11*c*, and 11*b* onto the intermediate transfer belt 21, an intermediate transfer bias with a polarity that is the reverse of the charging polarity of toner is applied to the primary transfer rollers 22*y*, 22*m*, 22*c*, and 22*b* by a constant voltage control. By this means, the yellow, magenta, cyan, and black toner images formed on the photoreceptor drums 11*y*, 11*m*, 11*c*, and 11*b* are transferred, superimposed one on another in order, to the toner image bearing surface 21*a* of the intermediate transfer belt 21, forming a multicolor toner image. However, in the event that image information of only one portion of yellow, magenta, cyan, and black is inputted, a toner image is formed only in an image forming unit corresponding to the color of the input image information from among the image forming units 10*y*, 10*m*, 10*c*, and 10*b*.

The support rollers 23, 24, and 25 are disposed so as to be rotatable about respective axes thereof by a driving portion (not shown), and support the intermediate transfer belt 21 therearound with tension and rotate it in the direction of the arrow 27. For each of the support rollers 23, 24, and 25, an aluminum-made cylinder (a pipe-shaped roller) is used, for example, having a diameter of 30 mm and a thickness of 1 mm. The support roller 24 comes into pressure-contact with a later-described secondary transfer roller 28 with the intermediate transfer belt 21 interposed therebetween, thus forming a secondary transfer nip region, and is electrically grounded. The support roller 24 has a function of imparting tension to the intermediate transfer belt 21 together with a function of secondarily transferring the toner image on the intermediate transfer belt 21 onto the recording sheet 8.

The belt cleaner 26 is a member for removing the toner which remains on the toner image bearing surface 21*a* after the toner image on the toner image bearing surface 21*a* of the intermediate transfer belt 21 is transferred onto the recording sheet 8 in the later-described secondary transfer section 4. The belt cleaner 26 is disposed opposite to the support roller 25 with the intermediate transfer belt 21 interposed therebetween. The belt cleaner 26 includes a cleaning blade and a toner storing container (any of them are not shown). The cleaning blade 26*a* is a plate-like member which comes into pressure-contact with the toner image bearing surface 21*a* of the intermediate transfer belt 21 by a pressure section (not shown) and scrapes off the residual toner and the like on the toner image bearing surface 21*a*. As the cleaning blade 26*a*, a blade made of a rubber material (e.g. urethane rubber) having elasticity may be used, for example. The toner storing container 26*b* serves to temporarily store the toner and the like scraped off by the cleaning blade 26*a*.

In the intermediate transfer section 3, the toner images formed on the photoreceptor drums 11*y*, 11*m*, 11*c*, and 11*b* are transferred and thus overlaid on top of one another at predetermined positions on the toner image bearing surface 21*a* of the intermediate transfer belt 21, thus forming a toner image. The toner image is secondarily transferred onto the recording sheet 8 in the secondary transfer nip region as described later. The toner, offset toner, paper dust, etc. which remain on the toner image bearing surface 21*a* of the intermediate transfer belt 21 after the secondarily-transferring operation, are removed by the belt cleaner 26. And onto the toner image bearing surface 21*a*, a toner image is transferred again.

The secondary transfer section 4 includes the support roller 24 and the secondary transfer roller 28. The secondary transfer roller 28 is a roller-shaped member which is disposed in pressure-contact with the support roller 24 with the intermediate transfer belt 21 interposed therebetween and so as to be rotatable about an axis of the member and which rotates by a driving portion (not shown). The secondary transfer roller 28 is composed of, for example, a metallic shaft and a conductive layer covering a surface of the metallic shaft. The shaft is, for example, formed of a metal such as stainless steel. The conductive layer is formed of a conductive elastic body or the like material. As the conductive elastic body, a material commonly used in this field is available, and examples thereof include EPDM, foamed EPDM, and urethane foam, which contain a conductive material such as carbon black.

The secondary transfer roller 28 is connected to a power source (not shown), and high voltage having a polarity opposite to the polarity of the charged toner is evenly applied to the secondary transfer roller 28. A pressure-contact region among the support roller 24, the intermediate transfer belt 21, and the secondary transfer roller 28 is a secondary transfer nip region. In the secondary transfer section 4, the toner image on the intermediate transfer belt 21 is conveyed to the secondary transfer nip region, and in synchronization therewith, the recording sheet 8 which is fed from the later-described recording sheet supplying section 5, is conveyed to the secondary transfer nip region where the toner image and the recording sheet 8 are thus stacked on each other so that the toner image is secondarily transferred onto the recording sheet 8. By so doing, an unfixed toner image is borne on the recording sheet 8. The recording sheet 8 bearing an unfixed toner image is conveyed to the fixing device 6.

(3) Fixing Device

The fixing device 6, by heating and pressurizing the recording sheet on which is formed the unfixed toner image, fixes the unfixed toner image to the recording sheet. The unfixed toner image is formed of toner included in a developer such as a nonmagnetic one-component developer formed of a nonmagnetic toner, a nonmagnetic two-component developer formed of a nonmagnetic toner and carrier, or a magnetic developer formed of a magnetic toner (which may hereinafter be referred to simply as a "developer").

Figure 3:
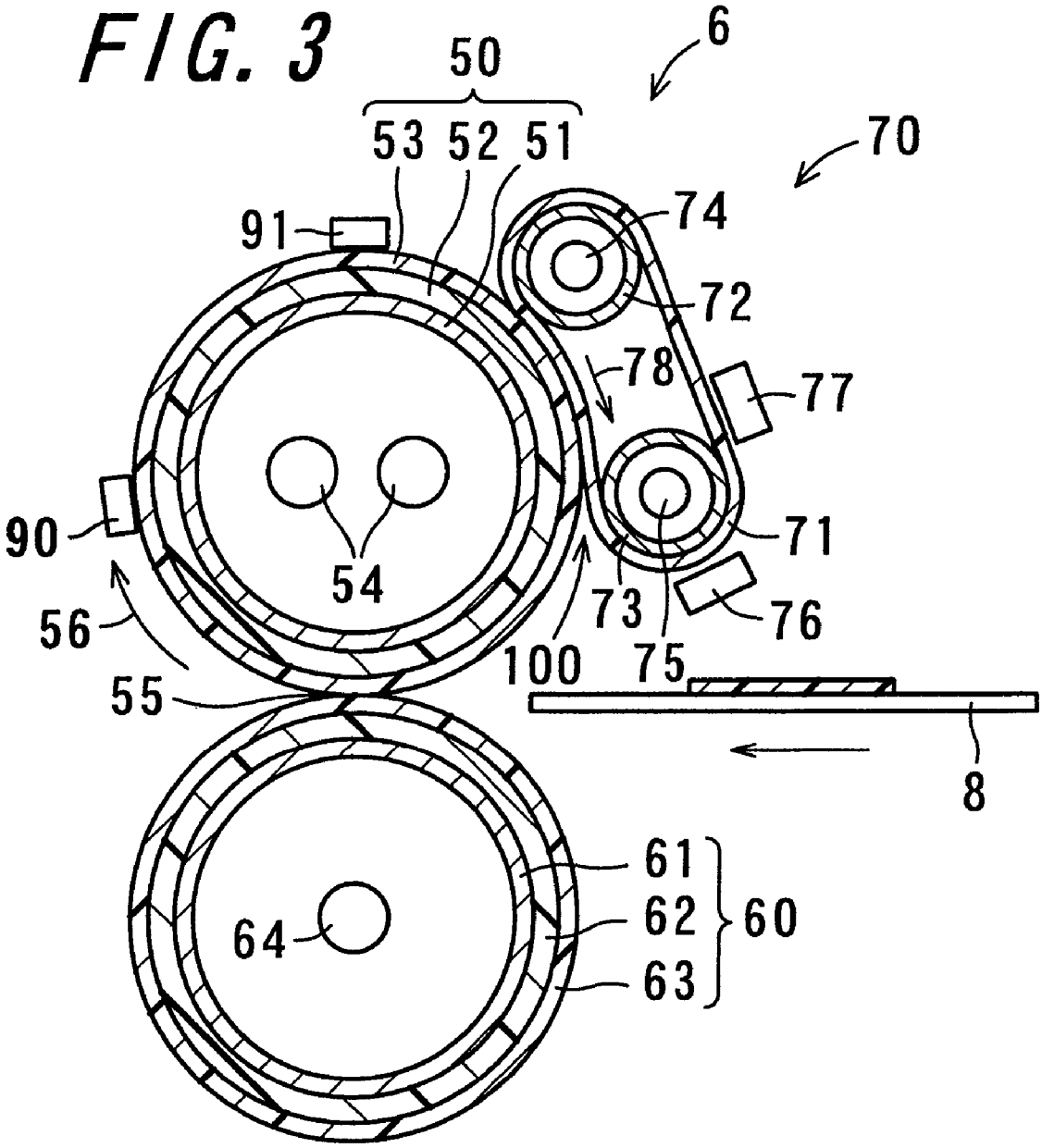
FIG. 3 is a sectional view schematically showing a configuration of a fixing device.

FIG. 3 is a sectional view schematically showing a configuration of the fixing device 6 according to the first embodiment of the invention. The fixing device 6 includes a fixing roller 50, a pressure roller 60, and an external heating section 70, as shown in FIG. 3.

(Fixing Roller)

The fixing roller 50 is a roller-shaped member which is rotatably supported by a supporting portion (not shown) and which rotates at a predetermined velocity in a direction of an arrow 56 by a driving portion (not shown). The fixing roller 50 heats and thus fuses the toner constituting the toner image borne on the recording sheet 8.

In the embodiment, as the fixing roller 50, a roller-shaped member is used which includes a metal core 51, an elastic layer 52, and a surface layer 53. A usable metal for forming the metal core 51 is a metal having high thermal conductivity such as aluminum and iron. Shape examples of the metal core 51 include a cylindrical shape, a columnar shape, and the like shape etc., and preferable is the cylindrical shape which discharges a small amount of heat from the metal core 51.

For constituting the elastic layer 52, any material having rubber elasticity may be used without particular limitation, and preferably used is a material which is also excellent in heat resistance. Specific examples of such a material include silicone rubber, fluoro-rubber, and fluorosilicone rubber. Among these materials, preferable is the silicone rubber which is particularly excellent in rubber elasticity.

For constituting the surface layer 53, any material may be used without particular limitation as long as the material has excellent heat resistance and durability and weak adherence to the toner. Specific examples of the material of the surface layer 53 include a fluorine resin material such as PFA (tetrafluoroethylene-perfluoroalkylvinylether copolymer) and PTFE (polytetrafluoroethylene), and a fluoro-rubber. The surface layer 53 is a PFA layer having a thickness of about 30 μm to 50 μm.

Fixing roller heating portions 54 are provided inside the fixing roller 50. They uniformly heat the fixing roller during a standby period, and also, prevent a decrease in surface temperature or the like of the fixing roller 50 due to heat being transferred to the recording sheet 8 at a toner image fixing time. In the embodiment, halogen lamps are used as the fixing roller heating portions 54.

As the fixing roller, a roller of 40 mm in outer diameter is used wherein a silicone rubber layer is formed to 2.5 mm on an aluminum metal core of 35 mm in outer diameter and 2 mm in wall thickness, and furthermore, a 40-μm PFA tube layer is provided thereon.

(Pressure Roller)

The pressure roller 60, a pressure member, is a roller-shaped member which is disposed below the lowest point in a vertical direction of the fixing roller 50 and disposed so as to be rotatable in pressure-contact with the fixing roller 50 by a pressurizing mechanism (not shown). A pressure-contact region between the fixing roller 50 and the pressure roller 60 is a fixing nip region 55. The pressure roller 60 is driven to rotate by rotation of the fixing roller 50. The pressure roller 60 heats and fixes the toner image onto the recording sheet 8 with the fixing roller 50. At this time, the pressure roller 60 presses the fused toner against the recording sheet 8 to thereby promote the fixing of the toner image onto the recording sheet 8.

In the embodiment, as the pressure roller 60, a roller-shaped member is used which includes a metal core 61, an elastic layer 62, and a surface layer 63. Usable materials for forming the metal core 61, the elastic layer 62, and the surface layer 63 are respectively the same metal or material which forms the metal core 51, elastic layer 52, and surface layer 53 of the fixing roller 50. Further, a shape of the metal core 61 is also the same as that in the case of the fixing roller 50. Inside the pressure roller 60, a heating portion 64 is provided. This shortens the start-up time of the image forming apparatus 1 after turning on the power source thereof until the state ready for image formation is set, and prevents a surface temperature of the fixing roller 60 from drastically lowering which is caused by heat transfer to the recording sheet 8 in fixing the toner image.

In the embodiment, a halogen lamp is used as the pressure roller heating portion 64. As the pressure roller, a roller of 40 mm in outer diameter is used wherein a silicone rubber layer is formed to 2.5 mm on an aluminum metal core of 35 mm in outer diameter and 2 mm in wall thickness, and furthermore, a 40-μm PFA tube layer is provided thereon.

(External Heating Section)

The external heating section 70 includes a heating belt 71, a first pressure-contact roller 72, a second pressure-contact roller 73, a thermistor 76, and a thermostat 77. The heating belt 71 is an endless belt-shaped member which is supported around the first pressure-contact roller 72 and the second pressure-contact roller 73 with tension to thereby form a loop-like travel path. Further, the heating belt 71 is arranged so as to contact with the fixing roller 50 in a band-shaped region which extends along a longitudinal direction of the fixing roller over a length in an outer circumferential direction of the fixing roller 50 from a pressure-contact point between the first pressure-contact roller 72 and the fixing roller 50 to a pressure-contact point between the second pressure-contact roller 73 and the fixing roller 50. Further, the heating belt 71 is driven to rotate in a direction of an arrow 78 by rotation of the fixing roller 50 in the direction of the arrow 56.

As the heating belt 71, any belt can be used without particular limitation as long as the belt is excellent in heat-resistance and durability. Examples of the heating belt 71 include a polyimide-made belt and a nickel electroformed belt. A surface of the heating belt 71 may be provided with a fluorine resin layer which is made of PFA, PTFE, or the like material. In the embodiment, an endless belt is used having a 90 μm-thick polyimide base material, which is formed into a cylindrical shape having a diameter of 31 mm, and a 20 μm-thick PTFE layer with which the polyimide base material is coated.

The first pressure-contact roller 72 and the second pressure-contact roller 73 are roller-shaped members which are rotatably supported and disposed so as to come into pressure-contact with a surface of the fixing roller 50 with heating belt 71 interposed therebetween, by a pressure section (not shown). The first pressure-contact roller 72 and the second pressure-contact roller 73 are driven to rotate by rotation of the heating belt 71 in the direction of the arrow 78.

As the first pressing roller 72 and second pressing roller 73, a metallic roller made of a metal with a high thermal conductivity such as aluminum or iron can be used. A fluorine resin layer may be formed on the surface of the metallic roller as necessary. In the embodiment, an aluminum roller of 2 mm in wall thickness and 16 mm in outer diameter is used.

The first pressure-contact roller 72 contains therein the first heating portion 74. The second pressure-contact roller 73 contains therein the second heating portion 75. These heating portions heat the heating belt 71 and thus the fixing roller 50. The first and second heating portions 74 and 75 are connected to a power source (not shown), and electric power is supplied to cause the first and second heating portions 74 and 75 to generate heat. As the first and second heating portions 74 and 75, a commonly-used heating portion can be used. In the embodiment, a halogen lamp is used for each of the first and second heating portions 74 and 75. Note that the first pressure-contact roller 72 and the second pressure-contact roller 73 are disposed so as to have respective axes thereof in parallel with each other on the fixing roller 50 and so as to be away from each other.

In a case in which the image forming apparatus is powered on and started up, when an image formation instruction is inputted, firstly, the heating belt 71 is heated to a first predetermined temperature by the halogen lamps provided inside the first pressing roller and second pressing roller. At the point at which the temperature of the heating belt 71 reaches the first predetermined temperature, the fixing roller 50 starts to be rotated at a speed of, for example, 225 mm/sec. The temperature of the heating belt 71 continues to be increased to a second predetermined temperature (herein, about 220° C.) while the fixing roller 50 is being rotated, the surface of the fixing roller 50 is heated with the heat from the heating belt 71, and the temperature of the surface of the fixing roller 50 is increased to a fixing temperature, completing the start-up. A start-up completion temperature is determined only from the surface temperature of the fixing roller 50. When the temperature of the heating belt 71 reaches the second predetermined temperature, the halogen lamps provided inside the first pressing roller and second pressing roller are put out.

In such a start-up operation, a condition where the halogen lamps inside the fixing roller 50 light up is only a condition where the temperature of the heating belt 71 reaches the second predetermined temperature and the halogen lamps inside the first pressing roller and second pressing roller are put out, and the halogen lamps inside the fixing roller 50 rarely light up in the start-up operation. Consequently, in the temperature distribution of the fixing roller at the completion of the start-up, the temperature of the fixing roller is the highest on the surface thereof, and tends to decrease gradually toward the interior thereof, that is, the metal core.

(Temperature Detection Section)

The second thermistor 76 is provided so as to be adjacent to the heating belt 71 in a position facing the second pressing roller 73 with the heating belt 71 interposed therebetween, and detects the temperature of the heating belt 71. A result of the detection by the second thermistor 76 is inputted into a CPU. From the determination result of the second thermistor 76, the CPU determines whether or not the temperature detected by the second thermistor 76 is within a setting range. In the event that the temperature detected by the second thermistor 76 is lower than a lower limit of the setting range, the CPU sends a control signal to the power source connected to the first and second heating portions 74 and 75, and supplies electric power to the first and second heating sections 74 and 75 to promote a heat generation. In the event that the temperature of the heating belt 71 is higher than an upper limit of the setting range, the CPU confirms whether or not electric power is supplied to the first and second heating portions 74 and 75. In the event that the supply of electric power is continued, the CPU sends a control signal which stops the supply of electric power to the first and second heating portions 74 and 75.

The second thermostat 77 is provided so as to be adjacent to the heating belt 71 in a position facing the second pressing roller 73 with the heating belt 71 interposed therebetween and downstream of the second thermistor 76 in the rotational direction of the heating belt 71, and detects an abnormal increase in temperature of the heating belt 71. A result of the detection by the second thermostat 77, is inputted into the CPU. In accordance with the detection result of the second thermostat 77, the CPU stops the supply of electric power from the power source connected to the first and second heating sections 74 and 75.

A first thermistor 90 which is the fixing member temperature detection section, is provided so as to be adjacent to the fixing roller 50, and detects the surface temperature of the fixing roller 50. A result of the detection by the first thermistor 90 is inputted into the CPU. From the detection result of the first thermistor 90, the CPU determines whether or not the temperature detected by the first thermistor 90 is within a setting range. In the event that the surface temperature of the fixing roller 50 is lower than a lower limit of the setting range, the CPU sends a control signal to the power source connected to the fixing roller heating portion 54, and supplies electric power to the fixing roller heating portion 54 to promote a heat generation. In the event that the surface temperature of the fixing roller 50 is higher than an upper limit of the setting range, the CPU confirms whether or not electric power is supplied to the fixing roller heating portion 54. In the event that electric power is supplied, the CPU sends a control signal which stops the supply of electric power and stops the supply of electric power from the power source connected to the fixing roller heating portion 54. In an interrupt control described hereinafter, the job printing is temporarily interrupted, or the job interrupt reference temperature is changed, depending upon the detection result of the first thermistor 90.

(4) Recording Sheet Supplying Section

The recording sheet supplying section 5 includes a recording sheet cassette 42, a pickup roller 43, and registration rollers 44*a* and 44*b*. The recording sheet cassette 42 stores the recording sheet 8. Specific examples of the recording sheet 8 include plain paper, coated paper, paper only for color copy, a film for OHP (overhead projector), and a post card. Size of the recording sheet 8 includes A4, A3, B5, B4, and a postcard size. The pickup roller 43 feeds the recording sheet 8 sheet by sheet to a conveyance path P. The registration rollers 44*a* and 44*b* are a pair of roller members which are disposed in pressure-contact with each other, and serve to feed the recording sheet 8 to the secondary transfer nip region in synchronization with conveyance of the multicolor toner image on the intermediate transfer belt 21 to the secondary transfer nip region. In the recording sheet supplying section 5, the recording sheet 8 stored inside the recording sheet cassette 42 is fed sheet by sheet to the conveyance path P by the pickup roller 43, and furthermore fed to the secondary transfer nip region by the registration rollers 44*a* and 44*b*.

(5) Scanner Section

The scanner section 7 includes a document platen, a light source, and a CCD image sensor 9. A document to be duplicated is placed on an upper surface of the document platen. A plate-like member formed of a transparent material such as transparent glass is used as the document platen. The light source illuminates the document placed on the document platen. The CCD image sensor 9 converts the reflected lights into image information (image signals) by photoelectrical conversion of lights reflected off the document illuminated by the light source. The CCD image sensor 9 including a conversion section, a forwarding section, and an output section, the conversion section converts light signals which are the reflected lights into electric signals, the forwarding section forwards the electric signals in order, to the output section in synchronization with clock pulses, and the output section converts the electric signals into voltage signals, amplifies them, makes their impedance low, and outputs them. Analog signals thus obtained are converted into digital signals by carrying out a heretofore known image processing. The document image information read by the scanner 7 is sent to a CPU (not shown) which controls all operations of the image forming apparatus and, after being subjected to various kinds of image processing, temporarily stored in a memory, and an image in the memory is retrieved in accordance with an output instruction, forwarded to the light scanning unit 13, and formed on recording paper which is the recording sheet 8.

(6) Control Unit

The image forming apparatus 1 is provided with the control unit (not shown). For example, the control unit is disposed in an upper part of internal space of the image forming apparatus 1 includes a memory portion (not shown), a calculation portion (not shown), and a control portion (not shown). In the memory portion are written, for example, a print command inputted by way of an operation panel (not shown) disposed on the top surface of the image forming apparatus 1, results detected by various sensors (not shown) disposed in various parts inside the image forming apparatus 1, image information inputted from an external equipment, various set values and data table which are used to control the operations of various components inside the image forming apparatus 1, and programs for performing the various controls.

For the memory portion, a device customarily used in this field can be used including, for example, a read only memory (ROM), a random access memory (RAM), and a hard disc drive (HDD). For the external equipment, an electrical and electronic equipment can be used which can form or obtain image information and which can be electrically connected to the image forming apparatus. Specific examples of the external equipment include a computer and a digital camera. The calculation portion takes out the various data (the print command, the detected result, the image information, etc.) inputted in the memory portion, and the program for performing the various controls. On the basis of the above various data and programs, the calculation portion conducts various detections and/or determinations. According to various results of determination and computational decisions obtained by the calculation portion, the control portion sends a control signal to a relevant device to control an operation thereof. The control portion and the calculation portion are, for example, a processing circuit which is realized by a microcomputer, a microprocessor, etc. having a central processing unit (CPU). The control unit includes a main power source together with the memory portion, the calculation portion, and the control portion. The main power source supplies electric power to not only the control unit but also the various devices inside the image forming unit 1. Furthermore, the control unit includes the interrupt control section described later.

Furthermore, the control unit controls the fixing device 6 including the fixing roller 50, the pressure roller 60, and the external heating section 70. The control unit sends a control signal to the power source (not shown) for supplying electric power to the heating portions 54, 64, 74, and 75 which are provided respectively inside the fixing roller 50, the pressure roller 60, the first pressure-contact roller 72, and the second pressure-contact roller 73. The command for image formation is inputted from an operation panel (not show) which is disposed on a top surface in a vertical direction of the image forming apparatus 1, or an external equipment such as a computer which is connected to the image forming apparatus 1. The power source which has received the control signal, supplies electric power to activate the heating portions 54, 64, 74, and 75. The heating portions 54, 64, 74, and 75 respectively heat the heating roller 50, the pressure roller 60, and the surface of the heating belt 71, up to the respective set temperatures. A temperature detecting sensor such as the first thermistor 90 is disposed near the fixing roller 50 and the external heating section 70, and detects that temperatures of the above components have reached the set temperatures. When such a detected result is inputted to the CPU, the control unit sends a control signal to a driving portion (not shown) for rotating the fixing roller 50, thereby driving the fixing roller 50 to rotate in the direction of the arrow 56. This also leads to driven rotation of the pressure roller 60 and the heating belt 71. In this state, the recording sheet 8 bearing the unfixed toner image is conveyed from the secondary transfer section 4 to the fixing nip region 55. When the recording sheet 8 passes through the fixing nip region 55, the toner constituting the toner image is heated and pressurized to be thereby fixed on the recording sheet 8, resulting in an image.

(Interrupt Control)

Figure 4A:
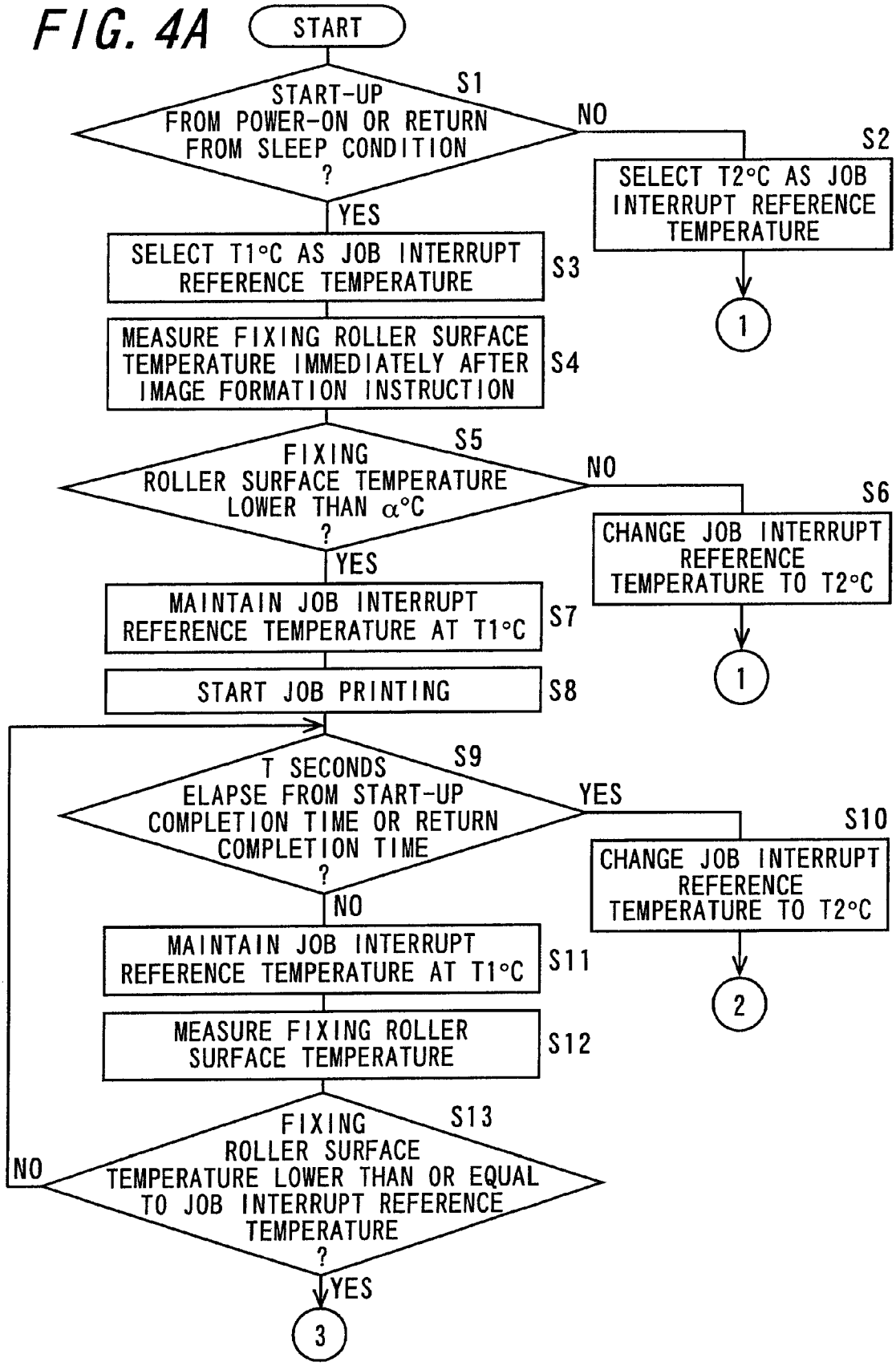
FIGS. 4A and 4B are flowcharts for explaining interrupt control.
Figure 4B:
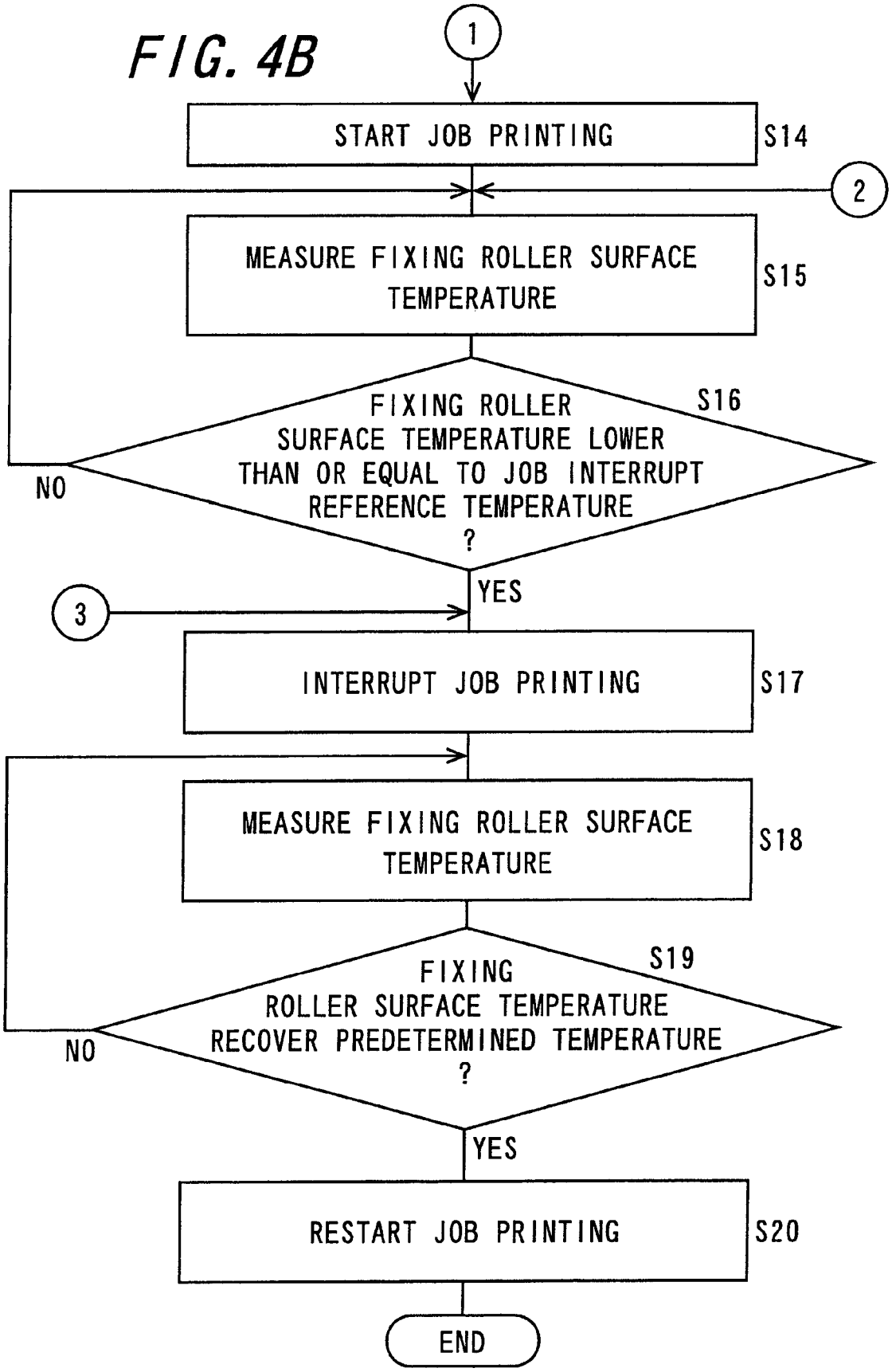

In the embodiment, in order to prevent the poor fixing due to the surface temperature of the fixing roller decreasing along with the job printing, the job interrupt reference temperature is set, and an interrupt control is carried out by the interrupt control section. FIGS. 4A and 4B are flowcharts for explaining the interrupt control. As described later, by the interrupt control shown in FIGS. 4A and 4B, when the surface temperature of the fixing roller during the job printing, which is detected by the first thermistor 90, decreases to the job interrupt reference temperature, the job printing is temporarily stopped, and started again after waiting for the surface temperature of the fixing roller to recover a predetermined temperature, and therefore it is possible to prevent the poor fixing from occurring due to the surface temperature of the fixing roller decreasing to a temperature lower than a lowest fixing temperature.

In the embodiment, at least two levels are set as the job interrupt temperature, and the interrupt control section individually selects, from among the at least two levels set as the job interrupt reference temperature, the level to be used for both of a job immediately after the start-up from the power-on and a job immediately after the return from the sleep mode, and the levels for other jobs, and carries out job printings using the selected level of job interrupt reference temperature. Since the at least two levels are set as job interrupt reference temperature, it is possible to select a level of job interrupt reference temperature which matches conditions. In the embodiment, the job interrupt reference temperature includes a first reference temperature and a second reference temperature, and the second reference temperature is a temperature lower than the first reference temperature. Also, there is a case where the job interrupt reference temperature is changed from an initial temperature depending on conditions, such as the surface temperature of the fixing roller at the start of the start-up, or time elapsing from a start-up completion point.

A description will be given, using FIG. 4A, of what kind of job interrupt reference temperature is to be selected in a case of what kind of condition. Main process steps of interrupt procedure will be described in FIG. 4B. A specific description will be given, using the flowcharts of FIGS. 4A and 4B, of the interrupt control and an advantage thereof, together with job interrupt reference temperature determination conditions. Hereinafter, S1 to S20 represent process procedure (step) numbers. In the embodiment, the "start-up" is specifically taken to be a start-up operation from a power-on condition, that is, a start-up condition from a condition in which a fixer is not energized.

Referring to FIG. 4A, in step S1, in the event that an input image formation instruction is a first image formation instruction after the image forming apparatus 1 is powered on, or an image formation instruction for returning the image forming apparatus 1 from the sleep mode, the process proceeds to step S3. In the event of an instruction other than the image formation instruction, for example, an instruction from a standby condition, the process proceeds to step S2. The image formation instruction is inputted from an operation panel (not shown) provided on an upper surface of the image forming apparatus 1 in a vertical direction, or an external instrument such as a computer connected to the image forming apparatus 1.

In step S2, the second reference temperature is selected as the job interrupt reference temperature. The interrupt control section carries out the interrupt control using the second reference temperature. As a kind of condition for proceeding to this step, examples thereof include a case where an input image formation instruction is an instruction inputted in the standby condition. Then, the process proceeds to step S14.

Referring to FIG. 4B, in step S14, when the surface temperature of the fixing roller 50 is increased to the fixing temperature, a job printing is started. In step 15, the surface temperature of the fixing roller 50 is detected by the first thermistor 90.

In step S16, it is determined whether or not the detected surface temperature of the fixing roller 50 is lower than or equal to the job interrupt reference temperature (T2° C.). When the detected surface temperature of the fixing roller 50 is lower than or equal to the job interrupt reference temperature, the process proceeds to step S17, while when the detected surface temperature of the fixing roller 50 is higher than the job interrupt reference temperature, the process goes back to step S15. In step S17, the job printing is interrupted.

In step S18, the surface temperature of the fixing roller 50 is detected by the first thermistor 90. In step S19, it is determined whether the detected surface temperature of the fixing roller 50 recovers a predetermined temperature (herein, a fixing temperature). When the detected surface temperature of the fixing roller 50 recovers the fixing temperature, the process proceeds to step S20, while when the detected surface temperature of the fixing roller 50 does not recover the fixing temperature, the process goes back to step S18. In step S20, the job printing is restarted, and the interrupt control is finished.

Figure 5:
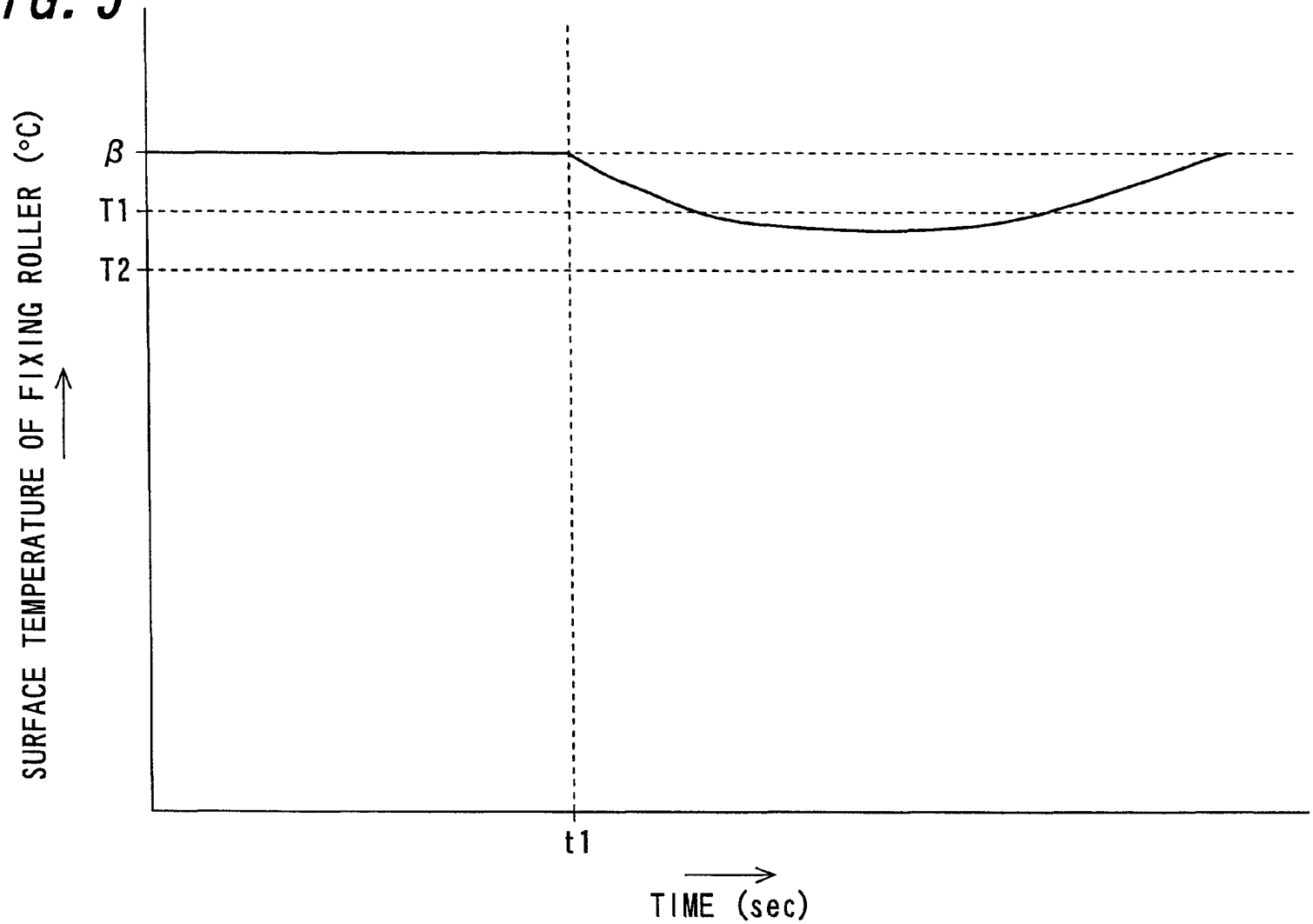
FIG. 5 is a graph showing a transition of the surface temperature of a fixing roller before and after the image formation instruction in a case of starting a job printing from the standby condition.

FIG. 5 is a graph showing a transition of the surface temperature of the fixing roller before and after the image formation instruction in a case of starting a job printing from the standby condition. As shown in FIG. 5, in the standby condition, the surface temperature of the fixing roller is maintained at β° C. which is the fixing temperature, and the job printing is started at the same time as an input of an image formation instruction at t1 seconds, immediately after which the surface temperature of the fixing roller starts to decrease. However, since the fixing roller is sufficiently heated from the interior thereof by the halogen lamps of the fixing roller heating sections 54 during the standby period, the rate of decrease in the surface temperature of the fixing roller is slow even in the event that the surface is deprived of heat due to the job printing.

Although there is a case where several sheets' worth of job printing is implemented even after it is detected that the surface temperature of the fixing roller has decreased to the job interrupt reference temperature, since the rate of decrease in the surface temperature is slow, the surface temperature of the fixing roller at the point at which the job printing is actually interrupted hardly decreases below the interrupt reference temperature. For this reason, no poor fixing occurs even in the event that, for example, the second reference temperature is set to the lowest fixing temperature, and therefore there is no problem. In the embodiment, the fixing temperature is taken to be 175° C., and the second reference temperature is taken to be a temperature of 155° C. which is 20° C. lower than the fixing temperature. Hereinafter, the first reference temperature may be described as T1° C., and the second reference temperature may be described as T2° C.

Provisionally, in the event that the job interrupt reference temperature is set to the first reference temperature in this step, when the surface temperature of the fixing roller decreases to T1° C., the job printing will be temporarily stopped. No poor fixing occurs either in the event that the job interrupt reference temperature is the first reference temperature, or in the event that the job interrupt reference temperature is the second reference temperature but, in the case of the first reference temperature, since the first reference temperature is higher than the second reference temperature, the job printing will be more likely to be interrupted than in the case of the second reference temperature, decreasing a job efficiency.

Referring to FIG. 4A, in step S3, in the event of the job immediately after the start-up from the power-on or immediately after the return from the sleep mode, the first reference temperature is selected. In the embodiment, the first reference temperature is taken to be a temperature of 170° C. which is 5° C. lower than the fixing temperature. Although there is a case where several sheets' worth of job printing is implemented even after it is detected that the surface temperature of the fixing roller has decreased to the job interrupt reference temperature, the fixing roller may be cooled down to room temperature at the start of the start-up from the power-on, and at the start of the return from the sleep mode, and in such a case, the rate of decrease in the surface temperature of the fixing roller due to the printing immediately after the start-up and immediately after the return is high, and therefore the poor fixing will be likely to occur. The reason why the first reference temperature is set to 170° C. which is a temperature 15° C. higher than the second reference temperature, is to cope with a rapid decrease in temperature of the fixing roller in this kind of case, and prevent the poor fixing from occurring. The interrupt control section sets the job interrupt reference temperature to T1° C.

As described in the description on the external heating section 70, in the event that the surface temperature of the fixing roller at the start of the start-up or at the start of the return is a temperature as low as room temperature, in the temperature distribution of the fixing roller at the completion of the start-up, the temperature of the fixing roller is the highest on the surface thereof, and tends to decrease gradually toward the interior thereof, that is, the metal core. Also, a dissipation of heat through the metal core in directions of end portions of the fixing roller axis is also great immediately after the start-up and immediately after the return, and the temperature of the fixing roller end portions tends to decrease in comparison with the temperature of the central portion of the fixing roller. For this reason, in the event that, provisionally, there is a single level of job interrupt reference temperature, the job interrupt reference temperature is set to T2° C., and a continuous paper feed is carried out, the surface temperature of the fixing roller decreases rapidly as in a curved line (b) shown in FIG. 8, and therefore there is a fear that the poor fixing occurs.

As described in steps S1 to S3, in the embodiment, the interrupt control section carries out the interrupt control by selecting the first reference temperature for a job immediately after the start-up from the power-on and immediately after the return from the sleep mode, and selecting the second reference temperature for a job other than the job immediately after the start-up from the power-on and immediately after the return from the sleep mode. Accordingly, in the event that the rate of decrease in the surface temperature of the fixing roller immediately after the printing is started is comparatively high, it is possible to set the job interrupt reference temperature to the first reference temperature which is comparatively high. And, in the event that the rate of decrease in the surface temperature of the fixing roller immediately after the printing is started is comparatively low, it is possible to set the job interrupt reference temperature to the second reference temperature which is comparatively low. Consequently, it is possible to ensure fixability, and at the same time, suppress the decrease in the job efficiency.

In step S4, the surface temperature of the fixing roller immediately after the image formation instruction is detected by the first thermistor 90.

In step S5, in the event that a result of detecting the surface temperature of the fixing roller shows that the surface temperature of the fixing roller is lower than a reference temperature, the process proceeds to step S7. In the event that it is higher than or equal to the reference temperature, the process proceeds to step S6. Hereinafter, the reference temperature will also be described as α° C. In the embodiment, the reference temperature is 70° C.

In step S6, in the event that the surface temperature of the fixing roller is higher than or equal to α° C., the job interrupt reference temperature is changed from the first reference temperature to the second reference temperature. Then, the interrupt procedure of steps S14 to S20 shown in above-mentioned FIG. 4B is carried out.

Figure 6:
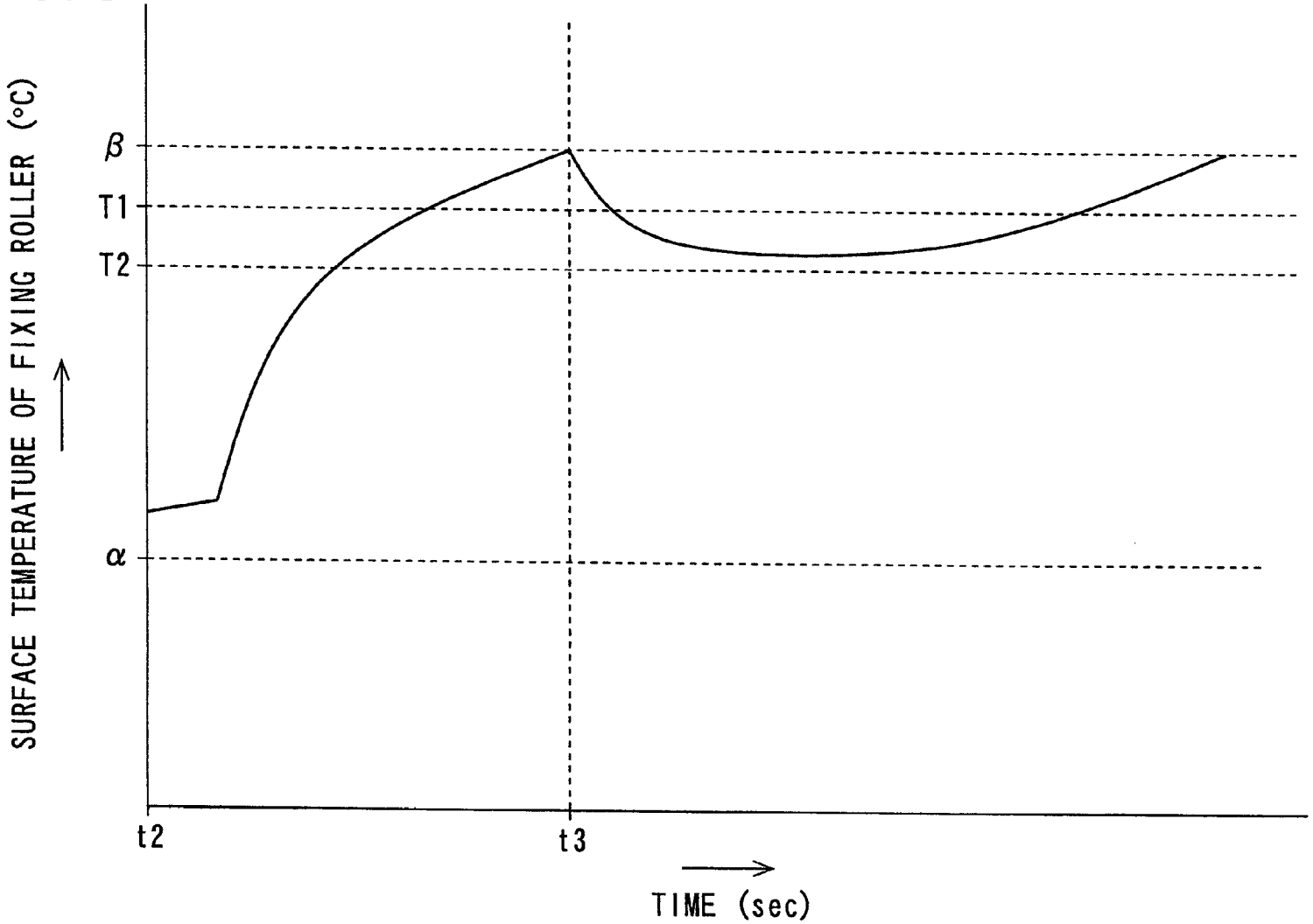
FIG. 6 is a graph showing a transition of the surface temperature of the fixing roller after a job printing is started from a point at which an image formation instruction is inputted in a case where the surface temperature of the fixing roller is higher than or equal to $\alpha^\circ$ C.

FIG. 6 is a graph showing a transition of the surface temperature of the fixing roller after a job printing is started from a point at which an image formation instruction is inputted in a case where the surface temperature of the fixing roller is higher than or equal to α° C. As shown in FIG. 6, when the image formation instruction is inputted at t2 seconds, the surface temperature of the fixing roller increases to β° C. The job printing is started at the same time as a rise at t3 seconds, and the surface temperature of the fixing roller starts to decrease immediately after the job printing is started. However, since the interior of the fixing roller, and the end portions of the roller too, are heated to some level, the rate of decrease in the surface temperature of the fixing roller is slow. For this reason, with a job immediately after a start-up from a condition in which the surface temperature of the fixing roller is higher than or equal to α° C., in the same way as in the case of step S2, there is little rapid decrease in temperature of the fixing roller. Accordingly, even in the event that the job interrupt reference temperature is set to a temperature (T2° C.) about 20° C. lower than the fixing temperature, there is no big problem for the fixability.

Provisionally, in the event that the job interrupt reference temperature in this step is not changed to the second reference temperature, but maintained at the first reference temperature, when the surface temperature of the fixing roller decreases to T1° C., the job printing will be temporarily stopped. Although no poor fixing occurs either in the event that the job interrupt reference temperature is the first reference temperature, or in the event that the job interrupt reference temperature is the second reference temperature, since the first reference temperature is higher than the second reference temperature, the job printing will be more likely to be interrupted than in the case of the second reference temperature, decreasing the job efficiency.

Referring to FIG. 4A, in step S7, in the event that the surface temperature of the fixing roller is lower than α° C., the job interrupt reference temperature is maintained at the first reference temperature. In the event that the surface temperature of the fixing roller is lower than α° C., it is determined that the fixing roller is cooled down, and the temperature thereof has decreased to room temperature. In this way, it is possible to suppress the poor fixing in the printing of the job immediately after the start-up from the power-on and immediately after the return from the sleep mode.

As described in steps S5 to S7, in the embodiment, in the case of starting the job printing by causing the start-up from the power-on, and in the case of starting the job printing by causing the return from the sleep mode, at the start of the start-up from the power-on, and at the start of the return from the sleep mode, in the event that the fixing roller surface temperature detected by the fixing member temperature detection section is higher than or equal to the predetermined temperature, the interrupt control section changes the job interrupt reference temperature from the first reference temperature to the second reference temperature, and carries out the interrupt control, while in the event that the fixing roller surface temperature detected by the fixing member temperature detection section is lower than the predetermined temperature, the interrupt control section maintains the job interrupt reference temperature at the first reference temperature, and carries out the interrupt control. For example, in the event that the apparatus is powered on and immediately off, and started up immediately after that, the surface temperature of the fixing roller hardly decreases, and still remains high. In this way, in the case in which the surface temperature of the fixing roller is high at the start of the start-up, even in the event of carrying out the interrupt control with the job interrupt reference temperature changed from the first reference temperature to the second reference temperature, no poor fixing occurs as the rate of decrease in the surface temperature of the fixing roller is low when printing the job immediately after the start-up. Also, since the job printing is continued without interruption even in the event that the surface temperature of the fixing roller decreases to the first reference temperature, it is possible to enhance the job efficiency further than in the case in which the interrupt control is carried out with the job interrupt reference temperature maintained at the first reference temperature. Consequently, it is possible to ensure the fixability, and at the same time, further suppress the decrease in the job efficiency.

In step 8, the surface temperature of the fixing roller increases to the fixing temperature, the start-up is completed, and at the same time, the job printing is started. The completion of the start-up is determined only by the surface temperature of the fixing roller. A start-up completion temperature is 175° C.

In step 9, in the event that a predetermined time has elapsed from the start-up completion time or the return completion time, the process proceeds to step S10. In the event that the predetermined time has not elapsed yet, the process proceeds to step S11. Hereinafter, the predetermined time may be described as t seconds. In the embodiment in which the second reference temperature is set to 170° C., the predetermined time is taken to be 30 seconds. The start-up completion time in this case is taken to be a point at which the surface temperature of the fixing roller reaches the fixing temperature.

In step 10, in the event that the predetermined time has elapsed from the start-up completion time or the return completion time, the job interrupt reference temperature is changed from T1° C. to T2° C. Then, the interrupt procedure of steps S17 to S20 shown in FIG. 4B is carried out.

In step 11, in a case in which the surface temperature of the fixing roller at the start of the start-up or the start of the return is lower than α° C., and time elapsing from the start-up completion time or the return completion time is within t seconds, the job interrupt reference temperature is maintained at T1° C.

In step S12, the surface temperature of the fixing roller 50 is detected by the first thermistor 90. In step S13, it is determined whether or not the detected surface temperature of the fixing roller 50 is lower than or equal to the job interrupt reference temperature (T1° C.). When the detected surface temperature of the fixing roller 50 is lower than or equal to the job interrupt reference temperature, the process proceeds to step S17, and the interrupt procedure of steps S17 to S20 is carried out. When the detected surface temperature of the fixing roller 50 is higher than the job interrupt reference temperature, the process goes back to step S9.

Figure 7:
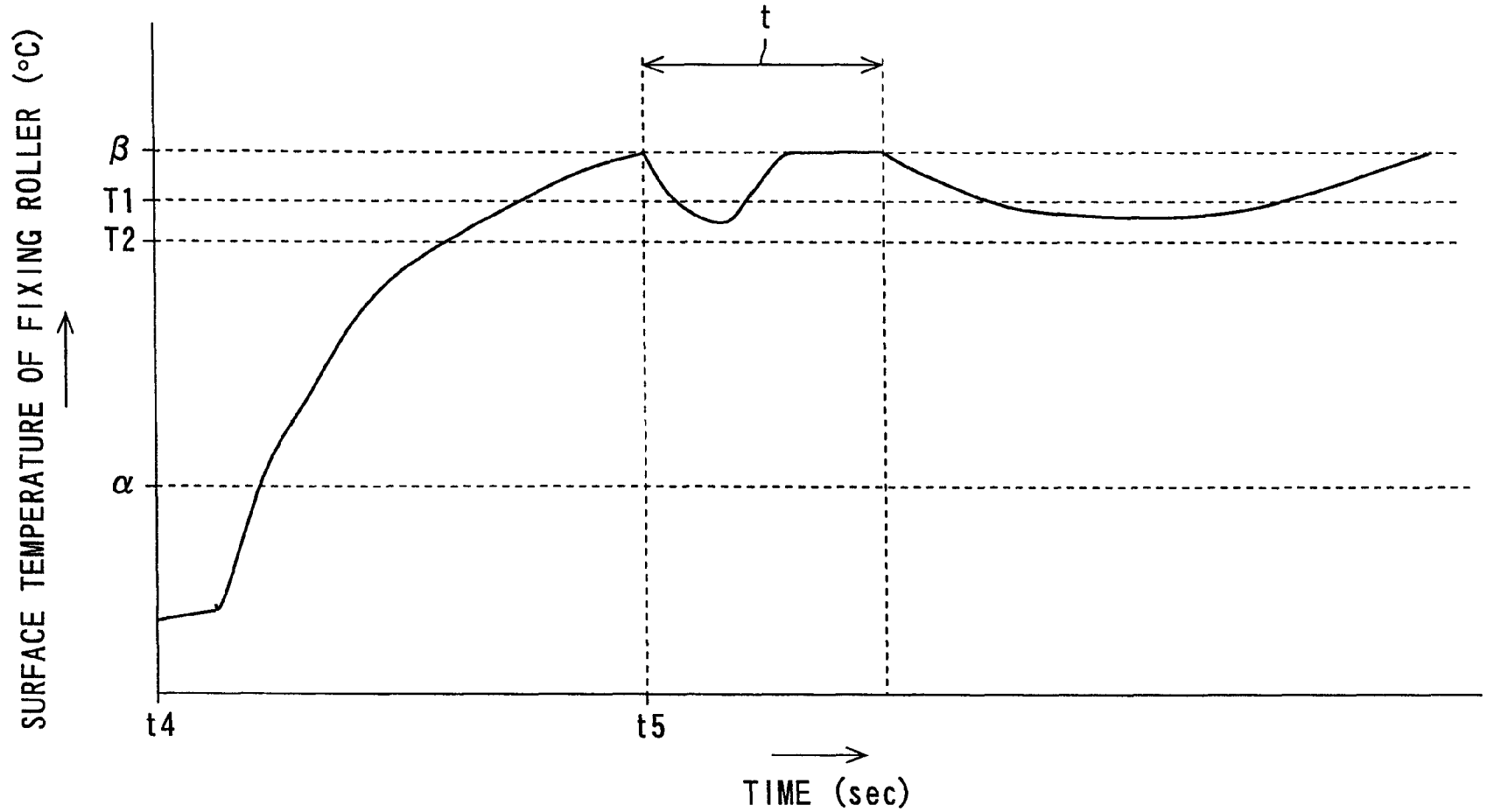
FIG. 7 is a graph showing a transition of the surface temperature of the fixing roller from the point at which the image formation instruction is inputted until t seconds have elapsed after the start-up completion time.

FIG. 7 is a graph showing a transition of the surface temperature of the fixing roller from the point at which the image formation instruction is inputted until t seconds have elapsed after the start-up completion time. As shown in FIG. 7, the image formation instruction is inputted at t4 seconds, and the surface temperature of the fixing roller increases to the fixing temperature. The job printing is started at the same time as the rise completion at t5 seconds, and the surface temperature of the fixing roller decreases rapidly immediately after the job printing is started but, as the job interrupt reference temperature is set to T1° C., it is possible to ensure the fixability. When t seconds have elapsed from the rise completion point, the rate of decrease in the surface temperature of the fixing roller will be slow as in FIGS. 5 and 6. This is because, at least the temperature of the metal core of the fixing roller becomes of about the same level as the surface temperature thereof when t seconds have elapsed from the start-up completion time and the return completion time, and therefore even in the event that the fixing roller surface is deprived of heat due to the continuous paper feed, heat is immediately supplied, suppressing a rapid decrease in temperature. Consequently, even in the event that the job interrupt reference temperature is changed to the second reference temperature, no poor fixing occurs, and therefore there is no problem.

Provisionally, in the event that the job interrupt reference temperature in this step is not changed to the second reference temperature, and maintained at the first reference temperature, when the surface temperature of the fixing roller decreases to T1° C. after t seconds elapse too, the job printing will be temporarily stopped. Although no poor fixing occurs either in the event that the job interrupt reference temperature is maintained at the first reference temperature even after t seconds elapse, or in the event that it is changed to the second reference temperature, the first reference temperature is higher than the second reference temperature, and therefore the job printing will be more likely to be interrupted than in the case of the second reference temperature, decreasing the job efficiency.

Figure 8:
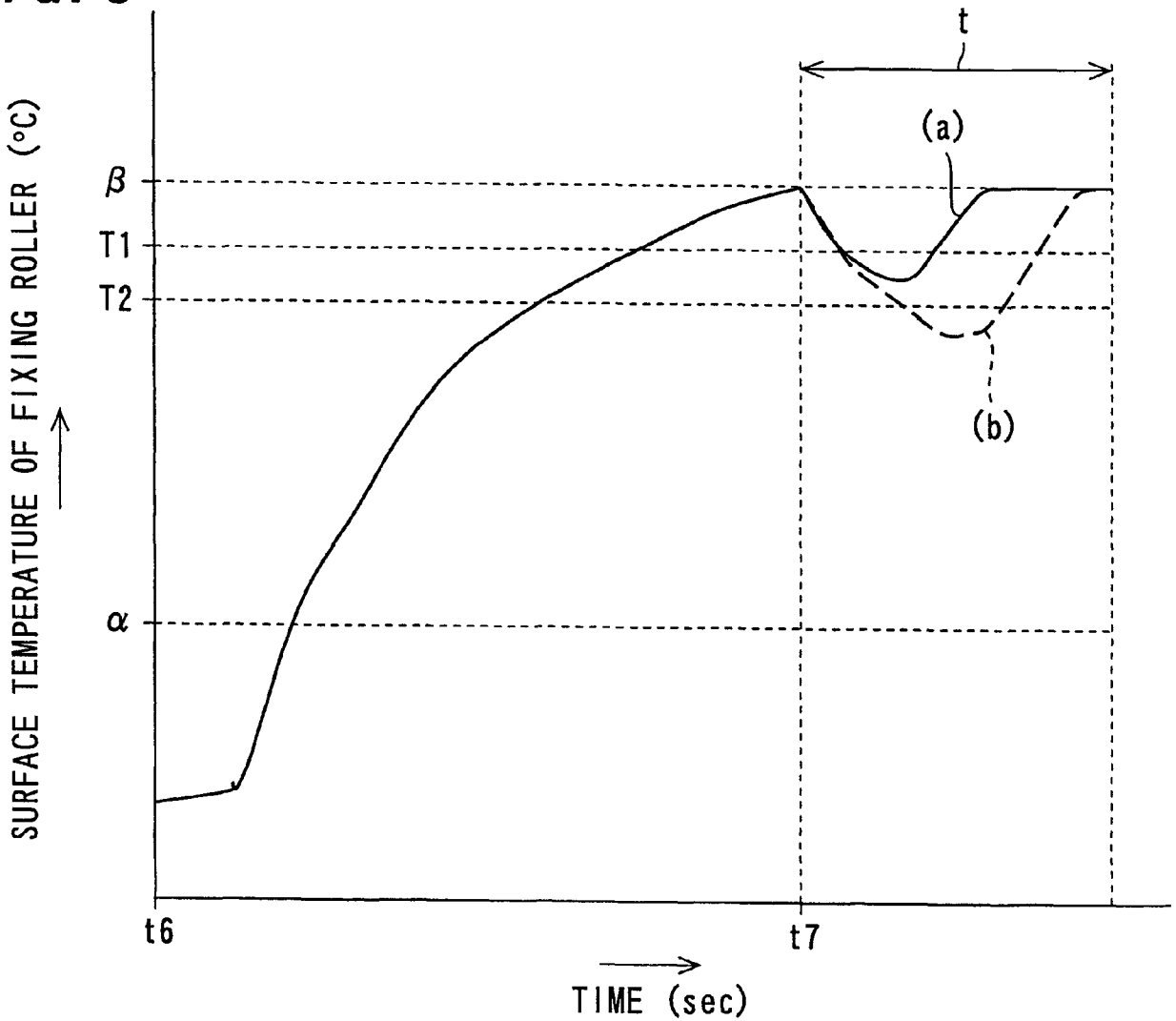
FIG. 8 is a graph showing a transition of the surface temperature of the fixing roller, which is lower than $\alpha^\circ$ C. at the start of the start-up, for t seconds elapsing from the image formation instruction input time until the start-up completion point.

FIG. 8 is a graph showing a transition of the surface temperature of the fixing roller, which is lower than α° C. at the start of the start-up, for t seconds elapsing from the image formation instruction input time until the start-up completion point. A curved line (a) is a graph in a case in which the job interrupt reference temperature is T1° C., and a curved line (b) is a graph in a case in which the job interrupt reference temperature is T2° C., as in this step. As shown in FIG. 8, when an image formation instruction is inputted at t4 seconds, the surface temperature of the fixing roller increases to β° C., and the start-up is completed at t7 seconds. When the job printing is carried out at the same time as the start-up completion, in the event that the job interrupt reference temperature is T1° C., the surface temperature of the fixing roller does not decrease rapidly as in the curved line (a), and therefore it is possible to ensure the fixability. In the event that the job interrupt reference temperature is T2° C., the surface temperature of the fixing roller decreases rapidly as in the curved line (b).

Provisionally, in the event that the job interrupt reference temperature is only T2° C., and this temperature is set to the lowest fixing temperature, the rate of decrease in the surface temperature of the fixing roller is severe in the printing of the job immediately after the start-up, and therefore the surface temperature of the fixing roller at the time when the job printing is actually interrupted falls far below the job interrupt reference temperature, due to which the poor fixing occurs.

As described in steps S9 to S11, in the embodiment, in the event that the job printing is started by causing the start-up from the power-on, and in the event that the job printing is started by causing the return from the sleep mode, it is assumed that the job interrupt reference temperature is the first reference temperature. In this case, when the predetermined time has elapsed from the time of completion of the start-up from the power-on and from the time of completion of the return from the sleep mode, the interrupt control section changes the job interrupt reference temperature to the second reference temperature, and carries out the interrupt control. When the predetermined time has elapsed from the time of completion of the start-up from the power-on, and from the time of completion of the return from the sleep mode, the fixing roller is heated as far as the interior thereof, and the rate of decrease in the surface temperature of the fixing roller along with the job printing becomes lower, and therefore no poor fixing occurs even in the event that the job interrupt reference temperature is changed to the comparatively low second reference temperature. Also, due to the fact that the job interrupt reference temperature has been changed, the job printing is continued without interruption even in the event that the surface temperature of the fixing roller decreases to the comparatively high first reference temperature, and therefore it is possible to enhance the job efficiency further than in the case in which the interrupt control is carried out with the job interrupt reference temperature changed to the first reference temperature. Consequently, it is possible to ensure the fixability, and at the same time, further suppress the decrease in the job efficiency.

In the embodiment, from among the at least two levels of the job interrupt reference temperature, the level to be used for both of a job immediately after the start-up from the power-on and a job immediately after the return from the sleep mode, and the level(s) for other job(s) are individually selected. However, in another embodiment, from among the at least two levels of job interrupt reference temperature, the level to be used for a job immediately after the start-up from the power-on, and the level(s) for other job(s) may be individually selected. Alternatively, from among the at least two levels of job interrupt reference temperature, the level to be used for a job immediately after the return from the sleep mode, and the level(s) for other job(s) may be individually selected.

REFERENCE EXAMPLES

Hereinafter, a description will be given of reference examples for showing advantages of the invention. In Reference Example 1, the job interrupt reference temperature is set to 155° C., the job printing is carried out immediately after the apparatus is started up from a surface temperature 25° C. of the fixing roller, and the fixability is evaluated. In Reference Example 2, the job printing is carried out in the same way as in Reference Example 1, except that the job interrupt reference temperature is changed from 155° C. to 170° C., and the fixability is evaluated.

Reference Example 1

As the fixing roller, a roller of approximately 40.0 mm in outer diameter is used wherein a 2.5-mm silicone rubber layer is formed on an aluminum metal core of 35 mm in outer diameter and 2 mm in wall thickness, and furthermore, a 40-μm PFA tube layer is provided thereon. As the pressure roller, a roller of approximately 40.0 mm in outer diameter is used wherein a 2.5 mm-silicone rubber layer is formed on an aluminum metal core of 35 mm in outer diameter and 2 mm in wall thickness, and furthermore, a 40-μm PFA tube layer is provided thereon. As the heating belt, an endless belt is used wherein a 90-μm thick polyimide base material formed in a 31 mm diameter cylindrical shape is coated with a PTFE layer of approximately 20 μm.

Aluminum rollers of 2 mm in wall thickness and 16 mm in outer diameter are used as the first pressing roller and second pressing roller. Also, 700W halogen lamps are provided inside the fixing roller, a 500W halogen lamp inside each of the first pressing roller and second pressing roller, and a 300W halogen lamp inside the pressure roller. As printing conditions, a process speed is taken to be 225 mm/sec, and a paper feed rate is taken to be 40 sheets/min, providing a condition for printing a color image. The fixing temperature is taken to be 175° C. As a chart for evaluating the fixability, one is used wherein an approximately 5-cm wide black solid image is formed at a tail end of paper. Using the chart, individual yellow, magenta, and cyan toners are overlaid one on another onto paper with a basis weight of 80 g/m$^2$, which is a weight per unit area of a recording sheet, and conditions for development, transfer, and the like are determined in such a way that an amount of toner attached to the paper is eventually 1.3 mg/cm$^2$.

Reference Example 2

The job printing is carried out in the same way as in Reference Example 1, except that the job interrupt reference temperature is changed from 155° C. to 170° C.

The fixability of Reference Example 1 and Reference Example 2 is evaluated using a bending test such that an image after being fixed (a portion corresponding to the black solid image in the previously described chart) is bent under a certain load condition, and subsequently rubbed under a certain load condition, and the width of a portion of the image removed by the rubbing (hereinafter described also as a "removed width") and the removed width of a limit sample are compared. A cylindrical 1 kg-brass weight is used in order to give a certain load. In the test, the narrower the removed width becomes, the better the fixability, and the wider the removed width becomes, the worse the fixability, and therefore the fixability is superior to that of the limit sample in the event that the removed width is narrower than that of the limit sample, while the fixability is inferior to that of the limit sample in the event that the removed width is wider than that of the limit sample. The limit sample is fabricated so that the removed width is approximately 200 to 300 μm by adjusting conditions such as the fixing temperature, and bending and rubbing the image after being fixed under the certain load condition in the way heretofore described, and can be constantly used for all fixability evaluations.

As fixability evaluation criteria, a case of having no occurrence of cold offset, and having fixability higher than that of the limit sample is rated as "Good", a case in which there is no occurrence of cold offset, and a result of the bending test is inferior to that of the limit sample, is rated as "Not bad", and a case in which cold offset occurs is rated as "Poor".

Evaluation results of Reference Example 1 and Reference Example 2 are shown in Table 1. The evaluation results are shown with the fixability divided into fixability in portions of the print sample fixed at the end portions of the fixing roller, and fixability in a portion thereof fixed in the central portion.

TABLE 1

| | Fixability | | |
|---|---|---|---|
| | Tail end | Center | Leading end |
| Reference Example 1 | Poor | Not bad | Poor |
| Reference Example 2 | Good | Good | Good |

As shown in Table 1, the poor fixing occurs in Reference Example 1 wherein the job reference temperature is set to 155° C. With the fixing roller immediately after the start-up from the surface temperature 25° C. of the fixing roller, as the frame and the like are not heated, heat is likely to be dissipated to their peripheral members through the metal core of the fixing roller. That is, since a dissipation of heat in the axial direction of the fixing roller occurs, the temperature of the end portions in the axial direction of the fixing roller is likely to decrease, and the poor fixing is likely to occur. For this reason, it is shown in Reference Example 1 that, in a case of causing the start-up from the surface temperature 25° C. of the fixing roller, in order to ensure the fixability throughout the axial direction of the fixing roller, it is necessary to set the job interrupt reference temperature to be high, and maintain the fixing roller temperature fairly high.

In Reference Example 2 wherein the job interrupt reference temperature is set to 170° C., no poor fixing occurs, and a good fixed image is obtained. From the results of Reference Examples 1 and 2, it is shown that, by selecting a job interrupt reference temperature based on the surface temperature of the fixing roller at the start of the start-up, it is possible to ensure the fixability, and at the same time, suppress the decrease in the job efficiency.

2. Program and Recording Medium

The interrupt control of the image forming apparatus 1 according to the first embodiment of the invention may be realized by means of software. That is, a central processing unit (CPU) which executes a command of an interrupt control program realizing each function, a read only memory (ROM) which stores the program, a random access memory (RAM) which expands the program, a storage device (a recording medium) such as a memory which stores the program and various data, and the like, are included, and an interrupt control device is constituted by them. Then, the object of the invention can also be achieved by supplying to the interrupt control device the recording medium on which program codes (an execute form program, an intermediate code program, and a source program) of the interrupt control program which is the software realizing the heretofore described functions are recorded so as to be readable by a computer, and retrieving and executing the program codes stored in the recording medium by the computer (or a CPU or MPU).

As the recording medium, it is possible to use, for example, a tape system such as a magnetic tape or cassette tape, a disk system including a magnetic disk such as a floppy (registered trademark) disk or hard disk, or an optical disk such as a CD-ROM, an MO, an MD, a DVD, or a CD-R, a card system such as an IC card (including a memory card) or optical card, or a semiconductor memory system such as a mask ROM, an EPROM, an EEPROM, or a flash ROM.

Also, the interrupt control device may be configured so as to be connectable to a communication network, and the program codes may be supplied via the communication network. As the communication network, which is not particularly limited, it is possible to utilize, for example, the Internet, an intranet, an extranet, a LAN, an ISDN, a VAN, a CATV communication network, a virtual private network, a telephone network, a mobile communication network, or a satellite communication network. Also, as a transmission medium constituting the communication network, which is not particularly limited, it is possible to utilize, for example, either a wired line such as an IEEE1394, a USB, a power line carrier, a cable TV line, a telephone line, or an ADSL, or a wireless line such as an infrared ray used in an IrDA or a remote control, Bluetooth (registered trademark), an 802.11 wireless LAN, an HDR, a portable telephone network, a satellite connection, or a digital terrestrial network. The invention can also be realized in the form of a computer data signal embedded in a carrier wave, in which the program codes are embodied by an electronic transmission.

In the embodiment, a description is given of the fixer using the external belt but, without being limited to an external belt method, it is also possible to apply the fixer to an external heating roller method.

3. Toner

Hereinafter, a description will be given of toner used when forming an image with the image forming apparatus of the invention.

The toner used in forming an image with the image forming apparatus of the invention, contains, for example, a binder resin, a colorant, and a release agent. As the binder resin, one customarily used in this field can be used, and examples thereof include polystyrene, a homopolymer of styrene substitute, a styrene-type copolymer, polyvinyl chloride, polyvinyl acetate, polyethylene, polypropylene, polyester, and polyurethane. The binder resins may be used each alone, or two or more thereof may be used in combination. Among these binder resins, for the color toner, preferable is a binder resin which has a softening temperature of 100° C. to 150° C. and a glass transition temperature of 50° C. to 80° C., and particularly preferable is polyester which has a softening temperature and a glass transition temperature in the above ranges, from the aspect of storage stability, durability, etc. Polyester in a softened or fused state is high in transparency. In the case where polyester is used as the binder resin, when a multicolor toner image composed of combined toner images of yellow, magenta, cyan, and black, is fixed on a recording sheet 8, the polyester itself becomes transparent, leading to sufficient color development by subtractive color mixture.

As the colorant, it is possible to use pigments and dyes for toner which have been conventionally used in the electrophotographic image forming technique. Examples of the pigment include an organic pigment such as azo pigment, benzimidazolone pigment, quinacridone pigment, phthalocyanine pigment, isoindolinone pigment, isoindoline pigment, dioxazine pigment, anthraquinone pigment, perylene pigment, perynone pigment, thioindigo pigment, quinophthalone pigment, or metal complex pigment; an inorganic pigment such as carbon black, titanium oxide, molybdenum red, chrome yellow, titanium yellow, chrome oxide, or Berlin blue; and metal powder such as aluminum powder. The pigments may be used each alone, or two or more thereof may be used in combination.

As the release agent, wax can be used, for example. The wax is customarily used in this field, and examples thereof include polyethylene wax, polypropylene wax, and paraffin wax. The toner may contain, other than the binder resin, colorant, and release agent, one or more additives for general use in toner, such as a charge control agent, a fluidity improving agent, a fixing promoting agent, and a conductive agent.

A volume average particle size of the toner is not particularly limited, and a preferable size thereof falls in a range of from 2 μm to 7 μm. When the volume average particle size of the toner is less than 2 μm, the toner may be degraded in fluidity, leading to insufficient supply, stirring, and charging of the toner upon the developing operation. This may cause a shortage of the toner amount, an increase of toner of reverse polarity, and the like problem, which possibly leads to a failure in forming high-quality images. When the volume average particle size of the toner exceeds 7 μm, a larger amount of the toner particles has such a large size that a center part of each toner particle is hard to be soften, with the result that a fixing property of the image onto the recording sheet 8 is degraded and moreover, the color development of the image is lower. And particularly in the case of fixing the image onto an OHP sheet, an obtained image is darker.

In the embodiment, the toner except the pigment has the same configuration as follows. The toner is a negatively-charged nonmagnetic insulating toner which has a glass transition temperature of 60° C., a softening temperature of 120° C., and a volume average particle size of 6 μm. When using the toner to obtain an image having an image density of 1.4 measured through a reflection densitometer type 310 manufactured by X-Rite Incorporated, a required toner amount is 5 $g/m^2$. The toner contains polyester (the binder resin) having a glass transition temperature of 60° C. and a softening temperature of 120° C., a low-molecular polyethylene wax (the release agent) having a glass transition temperature of 50° C. and a softening temperature of 70° C., and pigments of respective colors. A content of the wax is 7% by weight of the total amount of the toner while a content of the pigment is 12% by weight of the total amount of the toner, with the binder resin, i.e., polyester which occupies a remaining part of the total amount of the toner. The low-molecular polyethylene wax contained in the toner is wax whose glass transition temperature and softening temperature are lower than those of the polyester serving as the binder resin.

The toner can be manufactured according to the heretofore known methods such as a pulverization method, a suspension polymerization method, and an emulsification coagulation method. In the pulverizing method, the colorant, the release agent, etc. are molten and kneaded together with the binder resin, followed by pulverization. In the suspension polymerization method, the colorant, the release agent, a monomer of the binder resin, etc. are evenly dispersed, followed by polymerization of the monomer of the binder resin. In the emulsification coagulation method, binder resin particles, the colorant, the release agent, etc., are coagulated with the aid of a coagulant, and fine particles of a thus-obtained coagulated product are heated.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus including:

a toner image forming section which includes an image bearing member and forms a toner image on a surface of the image bearing member;

a transfer section which transfers the toner image on the surface of the image bearing member to a recording sheet;

a fixing device which fixes the unfixed toner on the recording sheet, the fixing device including:

a fixing member which heats the recording sheet bearing an unfixed toner image, and fuses toner constituting the unfixed toner image, a pressure member which is provided so as to be pressed against the fixing member to form a pressure-contact region between the pressure member and the fixing member, and pressurizes the recording sheet bearing the unfixed toner image which is conveyed to the pressure-contact region so as to fix the unfixed toner image on the recording sheet in cooperation with the fixing member, an external heating section which is provided so as to come into contact with a peripheral surface of the fixing member from an exterior thereof, and heats the peripheral surface, and a fixing member temperature detection section which detects a surface temperature of the fixing member; and an interrupt control section which carries out an interrupt control so as to interrupt a job printing when the surface temperature of the fixing member during the job printing which is detected by the fixing member temperature detection section decreases to a job interrupt reference temperature, wherein at least two levels are set as the job interrupt reference temperature, and the job interrupt control section individually selects, from among the at least two levels set as the job interrupt reference temperature, the level to be used for either or both of a job immediately after a start-up from a power-on and a job immediately after a return from a sleep mode, and the level(s) for other job(s), and carries out the interrupt control using the selected level of job interrupt reference temperature.

2. The image forming apparatus of claim 1, wherein the job interrupt reference temperature includes a first reference temperature and a second reference temperature lower than the first reference temperature, and the interrupt control section selects the first reference temperature for either or both of a job immediately after the start-up from the power-on and a job immediately after the return from the sleep mode, selects the second reference temperature for other job(s) and use these selected temperatures to carry out the interrupt control.

3. The image forming apparatus of claim 2, wherein in either or both of a case where a job printing is started from the power-on, and a case where a job printing is started by the return from the sleep mode, at the start of the start-up from the power-on, or at the start of the return from the sleep mode, in the event that the surface temperature of the fixing member detected by the fixing section temperature detection section is higher than or equal to a predetermined temperature, and the job interrupt reference temperature is the first reference temperature, the interrupt control section changes the job interrupt reference temperature from the first reference temperature to the second reference temperature, and carries out the interrupt control, while in the event that the surface temperature of the fixing member detected by the fixing section temperature detection section is lower than the predetermined temperature, the interrupt control section maintains the job interrupt reference temperature at the first reference temperature, and carries out the interrupt control.

4. The image forming apparatus of claim 2, wherein in either or both of a case where a job printing is started from the power-on, and a case where a job printing is started by the return from the sleep mode, when the job interrupt reference temperature is the first reference temperature, when a predetermined time has elapsed from the time of completion of the start-up from the power-on or the time of completion of the return from the sleep mode, the interrupt control section changes the job interrupt reference temperature to the second reference temperature, and carries out the interrupt control.

5. A computer readable recording medium on which an interrupt control program for carrying out the interrupt control of claim 1 is recorded, the interrupt control program causing a computer to function as the interrupt control section.

* * * * *